US010309627B2

(12) United States Patent
Heeter et al.

(10) Patent No.: US 10,309,627 B2
(45) Date of Patent: Jun. 4, 2019

(54) LIGHT FIXTURE RETROFIT KIT WITH INTEGRATED LIGHT BAR

(71) Applicant: CREE, INC., Durham, NC (US)

(72) Inventors: Shawn Heeter, Cary, NC (US); Vasavi Mandavilli, Cary, NC (US); Yaote Huang, Morrisville, NC (US); Mark Edward Dixon, Morrisville, NC (US); Kurt W Wilcox, Libertyville, IL (US); Nicholas W Medendorp, Jr., Raleigh, NC (US)

(73) Assignee: CREE, INC., Durham, NC (US)

( * ) Notice: Subject to any disclaimer, the term of this patent is extended or adjusted under 35 U.S.C. 154(b) by 0 days.

(21) Appl. No.: 13/763,270

(22) Filed: Feb. 8, 2013

(65) Prior Publication Data

US 2014/0126199 A1 May 8, 2014

Related U.S. Application Data

(63) Continuation-in-part of application No. 13/672,592, filed on Nov. 8, 2012, now Pat. No. 9,494,304.

(51) Int. Cl.
*F21K 9/27* (2016.01)
*F21V 21/08* (2006.01)
(Continued)

(52) U.S. Cl.
CPC ..... *F21V 21/08* (2013.01); *F21K 9/27* (2016.08); *F21V 21/088* (2013.01); *F21V 21/096* (2013.01)

(58) Field of Classification Search
CPC ..... F21V 21/08; F21V 21/088; F21V 21/096
(Continued)

(56) References Cited

U.S. PATENT DOCUMENTS

D85,382 S 10/1931 Guth ..... D26/24
3,589,660 A 6/1971 Dunckel
(Continued)

FOREIGN PATENT DOCUMENTS

CN 1710323 A 12/2005
CN 2872082 2/2007
(Continued)

OTHER PUBLICATIONS

Office Action from U.S. Appl. No. 13/464,745, dated Feb. 12, 2014.
(Continued)

*Primary Examiner* — Anh T Mai
*Assistant Examiner* — Zachary J Snyder
(74) *Attorney, Agent, or Firm* — Ferguson Case Orr Paterson LLP

(57) ABSTRACT

Retrofit systems and methods are disclosed for lighting installations, and in particular, to retrofit systems and methods used to retrofit troffer-style lighting installations with LED light sources. Retrofit systems can be used with different light fixtures, but those described are particularly adapted for use with troffer-style fixtures. These retrofit systems can provide the same amount of light as traditional light fixtures already do, for example 1600-4000 lumens or more. The retrofit systems can be used with many different light sources but are particularly well-suited for use with solid state light sources or light engines, such as those utilizing LEDs. Some embodiments of the present invention comprise a mechanical mounting system for installing an LED light engine within an existing lighting system housing or pan, such as a troffer pan, without penetrating the ceiling plenum.

29 Claims, 10 Drawing Sheets

(51) Int. Cl.
*F21V 21/088* (2006.01)
*F21V 21/096* (2006.01)

(58) Field of Classification Search
USPC ..... 362/396, 398
See application file for complete search history.

(56) References Cited

U.S. PATENT DOCUMENTS 4,118,763 A 10/1978 Osteen ..... 359/833
4,300,185 A 11/1981 Wakamatsu ..... 362/147
4,464,707 A 8/1984 Forrest ..... 362/271.06
4,472,767 A 9/1984 Wenman ..... 362/147
4,946,547 A 8/1990 Palmour et al.
5,200,022 A 4/1993 Kong et al.
5,335,890 A 8/1994 Pryor
5,361,195 A * 11/1994 Chen ..... A01K 63/06 362/101
RE34,861 E 2/1995 Davis et al.
5,530,628 A 6/1996 Ngai ..... 362/127
5,653,412 A 8/1997 Martorano
5,690,415 A 11/1997 Krehl ..... 362/125
5,823,663 A 10/1998 Bell et al. ..... 362/362
D407,473 S 3/1999 Wimbock ..... D23/328
5,907,218 A 5/1999 Altman et al.
5,951,150 A 9/1999 Helstern ..... 362/293
6,155,699 A 12/2000 Miller et al. ..... 362/293
6,190,198 B1 2/2001 Ray
6,210,025 B1 4/2001 Schmidt et al. ..... 362/362
6,435,697 B1 8/2002 Simmons ..... 362/219
6,443,598 B1 9/2002 Morgan ..... 362/342
6,523,974 B2 2/2003 Engel ..... 362/224
6,536,924 B2 3/2003 Segretto ..... 362/247
6,609,813 B1 * 8/2003 Showers ..... F21V 15/01 362/223
6,667,451 B1 12/2003 Hart ..... 200/314
6,739,734 B1 * 5/2004 Hulgan ..... 362/243
D496,121 S 9/2004 Santoro ..... D26/74
6,914,194 B2 7/2005 Fan
6,948,840 B2 9/2005 Grenda et al. ..... 362/555
7,049,761 B2 5/2006 Timmermans et al. ..... 315/246
7,131,747 B1 11/2006 Yates ..... 362/219
7,213,940 B1 5/2007 Van de Ven et al.
7,217,023 B2 5/2007 Iwasa et al. ..... 362/555
7,228,253 B2 6/2007 Chen ..... 318/11
7,267,461 B2 9/2007 Kan
D556,358 S 11/2007 Santoro ..... D26/74
7,303,310 B2 12/2007 You
7,387,410 B2 6/2008 Sibout ..... 362/375
7,510,299 B2 3/2009 Timmermans et al. ..... 362/225
7,520,636 B2 4/2009 Van Der Poel
D593,246 S 5/2009 Fowler et al. ..... D26/76
7,540,627 B2 6/2009 Handsaker ..... 362/225
7,559,672 B1 7/2009 Parkyn et al.
7,591,578 B2 9/2009 Chang
7,594,736 B1 9/2009 Kassay et al. ..... 362/223
D604,446 S 11/2009 Fowler et al. ..... D26/76
7,628,506 B2 12/2009 Verfuerth et al. ..... 362/218
D608,932 S 1/2010 Castelli ..... D26/76
7,654,702 B1 2/2010 Ding et al. ..... 362/294
7,654,703 B2 2/2010 Kan et al. ..... 362/362
7,659,702 B2 2/2010 Ding et al.
7,661,844 B2 2/2010 Sekiguchi et al. ..... 362/249
D611,183 S 3/2010 Duarte ..... D26/76
7,674,005 B2 3/2010 Chung ..... 362/147
7,686,484 B2 3/2010 Heiking et al. ..... 362/375
7,712,918 B2 5/2010 Siemiet et al. ..... 362/241
7,722,220 B2 5/2010 Van de Ven
D617,487 S 6/2010 Fowler et al. ..... D26/76
7,758,207 B1 7/2010 Zhou ..... 362/217.1
7,768,192 B2 8/2010 Van de Ven et al. ..... 313/503
7,791,061 B2 9/2010 Edmond et al.
7,815,338 B2 10/2010 Siemiet et al. ..... 362/218
7,857,482 B2 * 12/2010 Reo ..... F21V 5/008 362/225
7,868,484 B2 1/2011 Groff et al. ..... 362/375
D633,247 S 2/2011 Kong et al. ..... D26/88
7,988,335 B2 8/2011 Liu et al. ..... 362/294
7,997,762 B2 8/2011 Wang et al. ..... 362/249
8,058,088 B2 11/2011 Cannon et al.
D653,376 S 1/2012 Kong et al. ..... D26/76
8,092,049 B2 1/2012 Kinnune et al. ..... 362/294
8,201,968 B2 6/2012 Maxik et al.
8,206,004 B2 6/2012 Serak et al. ..... 362/217
8,220,953 B1 7/2012 Moore ..... 362/217.01
8,313,212 B1 11/2012 Mayer et al. ..... 362/219
8,317,369 B2 11/2012 McCanless ..... 362/368
8,342,714 B1 1/2013 Rea ..... 362/264
8,360,599 B2 1/2013 Ivey
8,376,578 B2 2/2013 Kong, II ..... 362/241
8,459,824 B1 6/2013 Esmailzadeh et al. ..... 362/147
8,480,252 B2 7/2013 Bertram et al. ..... 362/243
8,506,135 B1 8/2013 Oster ..... 362/373
8,523,383 B1 9/2013 Grigore et al. ..... 362/221
8,678,611 B2 3/2014 Chu ..... 313/110
8,714,770 B2 5/2014 Kato ..... 362/217.06
8,764,220 B2 7/2014 Chan et al. ..... 362/217.02
8,777,448 B2 7/2014 Shimizu ..... 362/235
8,888,314 B2 11/2014 Gill
9,057,493 B2 6/2015 Silmon
2001/0048599 A1 12/2001 Hess ..... 362/290
2004/0001344 A1 1/2004 Hecht ..... 362/555
2004/0240214 A1 12/2004 Whitlow et al. ..... 362/373
2004/0252521 A1 12/2004 Clark ..... 362/554
2005/0041418 A1 2/2005 Fan ..... 362/217.05
2005/0146867 A1 7/2005 Kassay ..... 362/217.05
2005/0264716 A1 12/2005 Kim et al.
2006/0050505 A1 3/2006 McCarthy ..... 362/219
2006/0266955 A1 11/2006 Arvin ..... 250/492.1
2006/0278882 A1 12/2006 Leung ..... 257/98
2007/0109330 A1 5/2007 Brown Elliott et al.
2007/0109779 A1 5/2007 Sekiguchi et al.
2007/0115670 A1 5/2007 Roberts et al.
2007/0115671 A1 5/2007 Roberts et al.
2007/0158668 A1 7/2007 Tarsa et al.
2007/0171647 A1 7/2007 Artwohl et al.
2007/0183148 A1 8/2007 Mayfield, III
2007/0211457 A1 9/2007 Mayfield et al. ..... 362/223
2007/0253205 A1 11/2007 Welker ..... 362/373
2008/0049422 A1 2/2008 Trenchard et al.
2008/0128723 A1 6/2008 Pang
2008/0173884 A1 7/2008 Chitnis et al.
2008/0179611 A1 7/2008 Chitnis et al.
2008/0232093 A1 9/2008 Kim
2008/0258130 A1 10/2008 Bergmann et al.
2008/0285267 A1 11/2008 Santoro ..... 362/224
2008/0314944 A1 * 12/2008 Tsai et al. ..... 224/331
2009/0009999 A1 1/2009 Wang
2009/0040782 A1 * 2/2009 Liu et al. ..... 362/555
2009/0046457 A1 2/2009 Everhart ..... 362/235
2009/0161356 A1 6/2009 Negley et al. ..... 362/231
2009/0184333 A1 7/2009 Wang et al.
2009/0185379 A1 7/2009 Chen
2009/0207602 A1 8/2009 Reed et al. ..... 362/225
2009/0212304 A1 8/2009 Wang et al.
2009/0224265 A1 9/2009 Wang et al.
2009/0225543 A1 9/2009 Jacobson et al.
2009/0237958 A1 9/2009 Kim
2009/0290345 A1 11/2009 Shaner ..... 362/249.01
2009/0290348 A1 11/2009 Van Laanen et al. ..... 362/249
2009/0296381 A1 12/2009 Dubord ..... 362/218
2009/0310354 A1 12/2009 Zampini et al. ..... 362/235
2009/0323334 A1 12/2009 Roberts et al.
2010/0002426 A1 1/2010 Wu ..... 362/223
2010/0014289 A1 1/2010 Thomas ..... 362/235
2010/0110679 A1 5/2010 Teng et al.
2010/0110701 A1 5/2010 Liu ..... 362/373
2010/0128485 A1 5/2010 Teng ..... 362/294
2010/0142205 A1 6/2010 Bishop ..... 362/249.02
2010/0155763 A1 6/2010 Donofrio et al.
2010/0171404 A1 7/2010 Liu et al. ..... 313/46
2010/0172133 A1 7/2010 Lie ..... 362/235
2010/0188609 A1 7/2010 Matsuki et al.
2010/0214770 A1 8/2010 Anderson ..... 362/133
2010/0220469 A1 9/2010 Ivey et al. ..... 362/218

(56) References Cited

U.S. PATENT DOCUMENTS

2010/0254128 A1 10/2010 Pickard et al.
2010/0254145 A1 10/2010 Yamaguchi
2010/0254146 A1 10/2010 McCanless
2010/0259927 A1 10/2010 Chien ..... 362/235
2010/0271804 A1* 10/2010 Levine ..... F21V 21/005 362/35
2010/0271825 A1 10/2010 Black
2010/0328945 A1 12/2010 Song et al. ..... 362/240
2011/0006688 A1 1/2011 Shim ..... 315/119
2011/0007514 A1* 1/2011 Sloan et al. ..... 362/368
2011/0013400 A1 1/2011 Kanno et al.
2011/0028006 A1* 2/2011 Shah et al. ..... 439/39
2011/0043132 A1 2/2011 Kim et al. ..... 362/235
2011/0090671 A1 4/2011 Bertram et al. ..... 362/84
2011/0090682 A1 4/2011 Zheng ..... 362/218
2011/0103043 A1 5/2011 Ago ..... 362/147
2011/0141734 A1 6/2011 Li et al. ..... 362/235
2011/0156584 A1 6/2011 Kim
2011/0163683 A1 7/2011 Steele et al. ..... 315/192
2011/0199005 A1 8/2011 Bretschneider et al.
2011/0199769 A1 8/2011 Bretschneider et al.
2011/0211330 A1 9/2011 Wang ..... 362/20
2011/0285314 A1 11/2011 Carney et al. ..... 315/294
2011/0286207 A1* 11/2011 Chan ..... F21V 15/013 362/217.1
2011/0286208 A1* 11/2011 Chen ..... F21K 9/30 362/217.1
2011/0310604 A1 12/2011 Shimizu ..... 362/235
2011/0310614 A1 12/2011 Budike, Jr. ..... 362/294
2012/0002408 A1 1/2012 Lichten et al. ..... 362/218
2012/0020109 A1 1/2012 Kim
2012/0038289 A1 2/2012 Jee et al.
2012/0051041 A1 3/2012 Edmond ..... 362/231
2012/0075857 A1* 3/2012 Verbrugh ..... 362/249.01
2012/0081883 A1* 4/2012 Wang ..... 362/101
2012/0092876 A1 4/2012 Chang et al.
2012/0098424 A1 4/2012 Arik ..... 315/35
2012/0120666 A1 5/2012 Moeller ..... 362/308
2012/0127714 A1 5/2012 Rehn
2012/0140459 A1* 6/2012 Sloan ..... F21K 9/00 362/217.02
2012/0140461 A1 6/2012 Pickard
2012/0169234 A1 7/2012 Shew ..... 315/88
2012/0182755 A1 7/2012 Wildner ..... 362/555
2012/0201023 A1* 8/2012 Yoneda ..... F21V 3/06 362/218
2012/0218757 A1 8/2012 Gill
2012/0235199 A1 9/2012 Andrews et al.
2012/0250302 A1 10/2012 Edwards
2012/0275154 A1* 11/2012 Hood ..... F21V 31/005 362/249.02
2012/0300409 A1* 11/2012 Lee ..... F21V 29/20 361/721
2013/0021803 A1 1/2013 Pickard
2013/0039090 A1 2/2013 Dau ..... 362/551
2013/0050998 A1 2/2013 Chu et al. ..... 362/218
2013/0093359 A1 4/2013 Hsu et al.
2013/0094224 A1 4/2013 Miyatake
2013/0094225 A1 4/2013 Leichner ..... 362/368
2013/0155670 A1* 6/2013 Handsaker ..... F21V 13/02 362/223
2013/0242548 A1 9/2013 Ter-Hovhannisyan
2013/0258616 A1 10/2013 Chao
2013/0271979 A1 10/2013 Pearson et al. ..... 362/235
2013/0279156 A1 10/2013 Kaule ..... 362/133
2013/0279180 A1 10/2013 Pearson et al. ..... 362/371
2013/0329425 A1 12/2013 Lowes et al.
2014/0043802 A1 2/2014 Dings
2014/0085861 A1 3/2014 Nicolai ..... 362/84
2014/0104843 A1 4/2014 McCane
2014/0265809 A1 9/2014 Hussell
2014/0313731 A1* 10/2014 Kwak ..... F21V 29/004 362/294
2015/0016100 A1 1/2015 Ishii ..... 362/223
2015/0022999 A1 1/2015 Yu et al.
2015/0155427 A1 6/2015 Jang
2016/0025278 A1 1/2016 Camarota

FOREIGN PATENT DOCUMENTS

CN 101188261 5/2008
CN 101994939 3/2011
CN 101994939 A 3/2011
CN 1019844284 3/2011
CN 202580962 12/2012
DE 102007030186 1/2009
DE 202010001832 7/2010
EP 1298383 A2 4/2003
EP 1357335 A2 10/2003
EP 1653254 3/2006
EP 1737051 12/2006
EP 1847762 A2 10/2007
EP 1860467 11/2007
JP 2002244027 11/2002
JP 2004140327 5/2004
JP 2011018571 8/2011
JP 2011018572 8/2011
KR 20100012997 12/2010
WO WO 03102467 12/2003
WO WO 2008003289 1/2008 ..... F21S 4/003
WO WO 2009140761 A1 11/2009
WO WO 2009157999 A1 12/2009
WO WO 2010042216 A2 4/2010
WO WO 2011074424 A1 6/2011
WO WO 2011096098 A1 8/2011
WO WO 2011098191 8/2011
WO WO 2011118991 A2 9/2011
WO WO 2011140353 A2 11/2011
WO WO2012/163625 * 12/2012 ..... F21V 3/02

OTHER PUBLICATIONS

Office Action from U.S. Appl. No. 13/453,924, dated Feb. 19, 2014.
Office Action from U.S. Appl. No. 13/341,741, dated Jan. 14, 2014.
Office Action from U.S. Appl. No. 13/370,252, dated Dec. 20, 2013.
Preliminary Report and Written Opinion from PCT appl. No. PCT/US2012/047084, dated Feb. 6, 2014.
Search Report and Written Opinion from PCT Patent Appl. No. PCT/US2012/047084, dated Feb. 27, 2013.
Search Report and Written Opinion from PCT Patent Appl. No. PCT/US2012/071800, dated Mar. 25, 2013.
Office Action from U.S. Appl. No. 13/429,080, dated Apr. 18, 2014.
Office Action from U.S. Appl. No. 12/961,385, dated Mar. 11, 2014.
International Search Report and Written Opinion from Appl. No. PCT/CN2013/072772, dated Dec. 19, 2013.
Office Action from U.S. Appl. No. 29/387,171, dated May 2, 2012.
Response to OA from U.S. Appl. No. 29/387,171, filed Aug. 2, 2012.
Office Action from U.S. Appl. No. 12/961,385, dated Apr. 26, 2013.
Response to OA from U.S. Appl. No. 12/961,385, filed Jul. 24, 2013.
Office Action from U.S. Appl. No. 13/464,745, dated Jul. 16, 2013.
Office Action from U.S. Appl. No. 29/368,970, dated Jun. 19, 2012.
Office Action from U.S. Appl. No. 29/368,970, dated Aug. 24, 2012.
Response to OA from U.S. Appl. No. 29/368,970, filed Nov. 26, 2012.
International Search Report and Written Opinion from PCT/US2013/049225, dated Oct. 24, 2013.
U.S. Appl. No. 13/649,052, filed Oct. 10, 2012, Lowes, et al.
U.S. Appl. No. 13/649,067, filed Oct. 10, 2012, Lowes, et al.
XLamp® C family from Cree®, Inc., Product Family Data Sheet, 15 pages.
XLamp® M family from Cree®, Inc., Product Family Data Sheet, 14 pages.
XLamp® X family from Cree®, Inc., Product Family Data Sheet, 17 pages.
Notice to Submit a Response from Korean Patent Application No. 30-2011-0038115, dated Dec. 12, 2012.

(56) References Cited

OTHER PUBLICATIONS

Notice to Submit a Response from Korean Patent Application No. 30-2011-0038116, dated Dec. 12, 2012.
International Search Report and Written Opinion for PCT Application No. PCT/US2011/062396, dated Jul. 13, 2012.
International Search Report and Written Opinion for Patent Application No. PCT/US2011/001517, dated Feb. 27, 2012.
U.S. Appl. No. 12/418,796, filed Apr. 6, 2009.
U.S. Appl. No. 13/429,080, filed Mar. 23, 2012.
U.S. Appl. No. 13/028,946, filed Feb. 16, 2011.
U.S. Appl. No. 13/306,589, filed Nov. 29, 2011.
U.S. Appl. No. 12/873,303, filed Aug. 31, 2010 to Edmond, et al.
U.S. Appl. No. 12/961,385, filed Dec. 6, 2010 to Pickard, et al.
Cree's XLamp XP-E LED's, data sheet, pp. 1-16.
Cree's XLamp XP-G LED's, data sheet, pp. 1-12.
Office Action from Japanese Design Patent Application No. 2011-18570.
Reason for Rejection from Japanese Design Patent Application No. 2011-18571.
Reason for Rejection from Japanese Design Patent Application No. 2011-18572.
International Search Report and Written Opinion from PCT Application No. PCT/US2013/021053, dated Apr. 17, 2013.
Office Action from U.S. Appl. No. 29/449,316, dated Jun. 5, 2014.
Office Action from U.S. Appl. No. 13/842,150, dated Jun. 18, 2014.
Leviton LED Magnetic Tube Retrofit Series datasheet. 1 page, from www.leviton.com.
Final Rejection issued in Korean Design Appl. No. 30-2011-0038114, dated Jun. 14, 2013.
Final Rejection issued in Korean Design Appl. No. 30-2011-0038115, dated Jun. 14, 2013.
Final Rejection issued in Korean Design Appl. No. 30-2011-0038116, dated Jun. 17, 2013.
International Search Report and Written Opinion from PCT Patent Appl. No. PCT/US2013/035668, dated Jul. 12, 2013.
Restriction Requirement from U.S. Appl. No. 13/839,130, dated Jul. 28, 2014.
Office Action from U.S. Appl. No. 13/839,130, dated Sep. 25, 2014.
Office Action from U.S. Appl. No. 13/829,558, dated Sep. 30, 2014.
Office Action from U.S. Appl. No. 29/450,283, dated Nov. 5, 2014.
Office Action from U.S. Appl. No. 29/449,316, dated Nov. 26, 2014.
Office Action from U.S. Appl. No. 13/840,812, dated Nov. 28, 2014.
Office Action from U.S. Appl. No. 13/672,592, dated Jan. 7, 2015.
Office Action from U.S. Appl. No. 13/899,314, dated Jan. 15, 2015.
Office Action from U.S. Appl. No. 13/842,150, dated Jan. 22, 2015.
Office Action from U.S. Appl. No. 13/829,558, dated Mar. 9, 2015.
Office Action from U.S. Appl. No. 13/958,462, dated Mar. 10, 2015.
Office Action from U.S. Appl. No. 14/252,685, dated Oct. 1, 2015.
Office Action from U.S. Appl. No. 13/958,461, dated Oct. 15, 2015.
Office Action from U.S. Appl. No. 13/910,486, dated Oct. 15, 2015.
Response to OA from U.S. Appl. No. 13/910,486, filed Dec. 15, 2015.
Office Action from U.S. Appl. No. 13/782,620, dated Oct. 30, 2015.
Office Action from U.S. Appl. No. 13/899,314, dated Nov. 13, 2015.
Response to OA from U.S. Appl. No. 13/899,314, filed Dec. 16, 2015.
Office Action from U.S. Appl. No. 13/672,592, dated Nov. 23, 2015.
Office Action from U.S. Appl. No. 14/020,750, dated Dec. 14, 2015.
Office Action from U.S. Appl. No. 13/834,605, dated Apr. 9, 2015.
Office Action from U.S. Appl. No. 13/840,812, dated May 12, 2015.
Office Action from U.S. Appl. No. 13/910,486, dated May 7, 2015.
Office Action from U.S. Appl. No. 13/910,486; dated Mar. 1, 2016.
Office Action from U.S. Appl. No. 14/108,168; dated May 20, 2016.
Office Action from U.S. Appl. No. 14/252,685; dated May 20, 2016.
Office Action from U.S. Appl. No. 14/108,168; dated Dec. 24, 2015.
Office Action from U.S. Appl. No. 13/842,150; dated Dec. 30, 2015.
Office Action from U.S. Appl. No. 13/899,314; Feb. 4, 2016.
Office Action from U.S. Appl. No. 14/070,098; Feb. 5, 2016.
Office Action from U.S. Appl. No. 13/829,558; Feb. 19, 2016.
Office Action for U.S. Appl. No. 14/108,168; dated Nov. 15, 2016.
Office Action for U.S. Appl. No. 13/910,486; dated Dec. 14, 2016.
Chinese Office Action Application No. 201310236572; dated Jan. 4, 2017.
Office Action for U.S. Appl. No. 14/020,750; dated Jan. 25, 2017.
Office Action for U.S. Appl. No. 13/958,461; dated Jun. 17, 2016.
Office Action for U.S. Appl. No. 13/910,486; dated Jun. 23, 2016.
Office Action from U.S. Appl. No. 14/020,750; dated Jul. 20, 2016.
Office Action from U.S. Appl. No. 13/829,558; dated Aug. 16, 2016.
Office Action from U.S. Appl. No. 14/070,096; dated Sep. 9, 2016.
Office Action for U.S. Appl. No. 14/252,685; dated Apr. 7, 2017.
Office Action for U.S. Appl. No. 13/829,558; dated Apr. 10, 2017.
Office Action for U.S. Appl. No. 13/910,486; dated Apr. 20, 2017.
Office Action for U.S. Appl. No. 14/108,168; dated Jun. 20, 2017.
Office Action for U.S. Appl. No. 14/070,098; dated Jul. 7, 2017.
Foreign Office Action or Chinese Application No. 2013101236572; dated Jul. 10, 2017.
Office Action for U.S. Appl. No. 13/910,486; dated Aug. 28, 2017.
Office Action for U.S. Appl. No. 13/829,558; dated Oct. 4, 2017.
Office Action for U.S. Appl. No. 14/252,685; dated Oct. 20, 2017.
Office Action for U.S. Appl. No. 14/070,098; dated Oct. 23, 2017.
Office Action for U.S. Appl. No. 14/108,168; dated Nov. 2, 2017.
Search Report for Chinese Application No. 2013101236572; dated Jan. 22, 2018.
Fourth Office Action for Chinese Application No. 2013101236572; dated Jan. 30, 2018.
Office Action for U.S. Appl. No. 13/910,486; dated Feb. 5, 2018.
Office Action for U.S. Appl. No. 14/108,168; dated Mar. 22, 2018.
Office Action for U.S. Appl. No. 13/829,558; dated May 2, 2018.
Office Action for U.S. Appl. No. 13/910,486; dated Jun. 29, 2018.
Office Action for U.S. Appl. No. 14/070,098; dated Jun. 28, 2018.
Office Action from U.S. Appl. No. 13/899,314, dated Jul. 29, 2015.
Response to OA from U.S. Appl. No. 13/899,314, filed Sep. 15, 2015.
Office Action from U.S. Appl. No. 13/672,592, dated Aug. 6, 2015.
Response to OA from U.S. Appl. No. 13/672,592, filed Sep. 21, 2015.
Office Action from U.S. Appl. No. 13/842,150, dated Aug. 10, 2015.
Office Action from U.S. Appl. No. 13/829,558, dated Sep. 11, 2015.

* cited by examiner

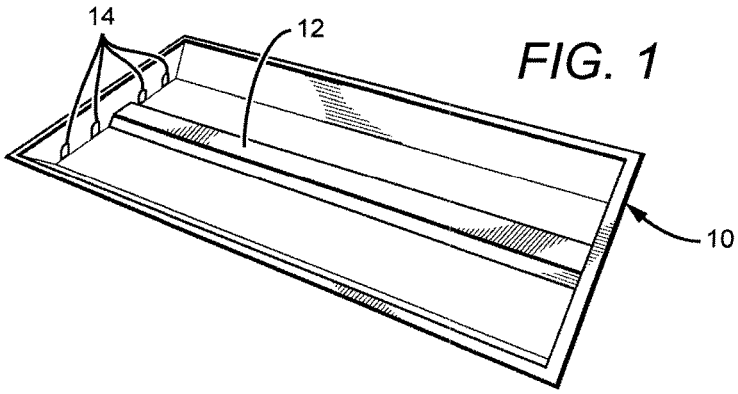
FIG. 1
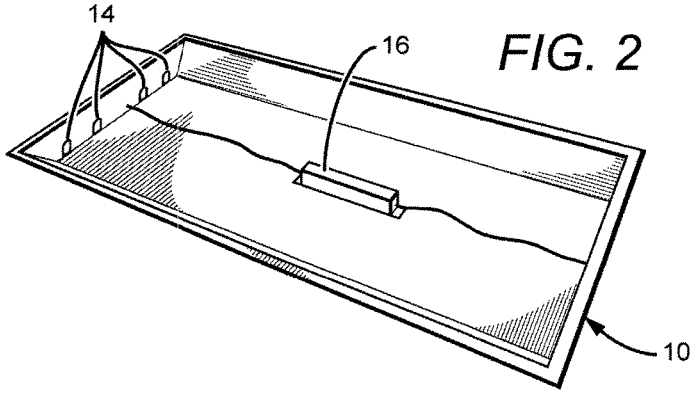
FIG. 2
FIG. 3
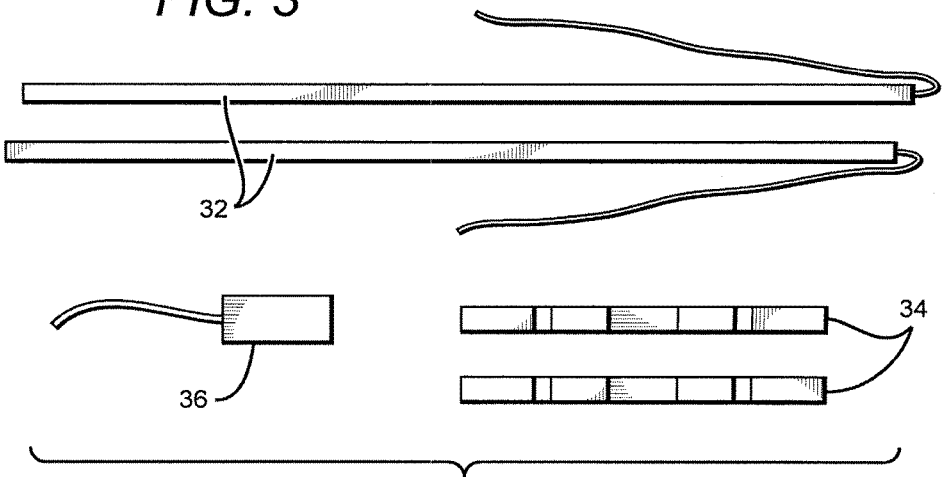

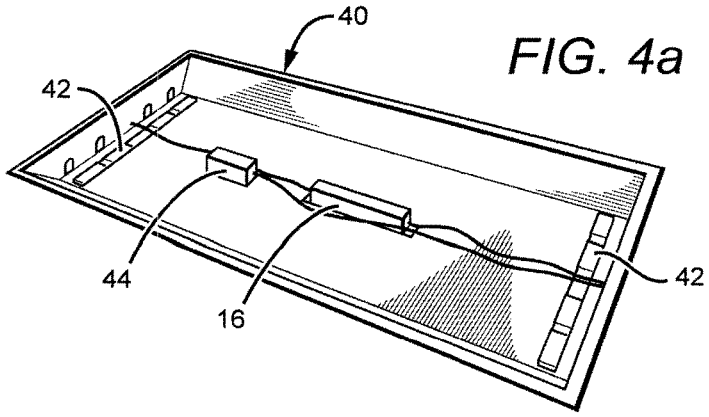
FIG. 4a
FIG. 4b
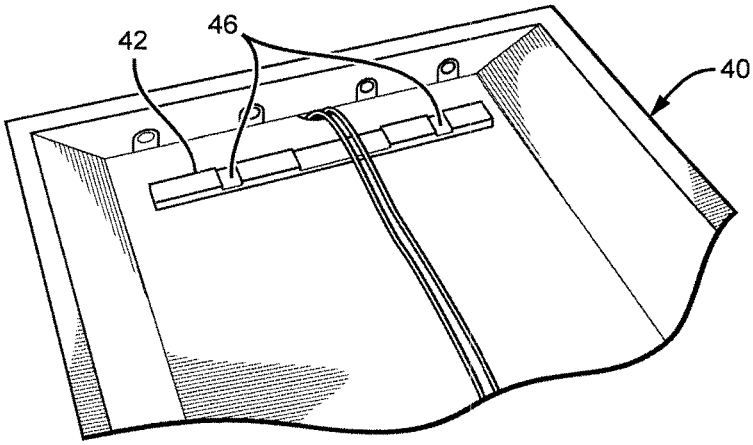
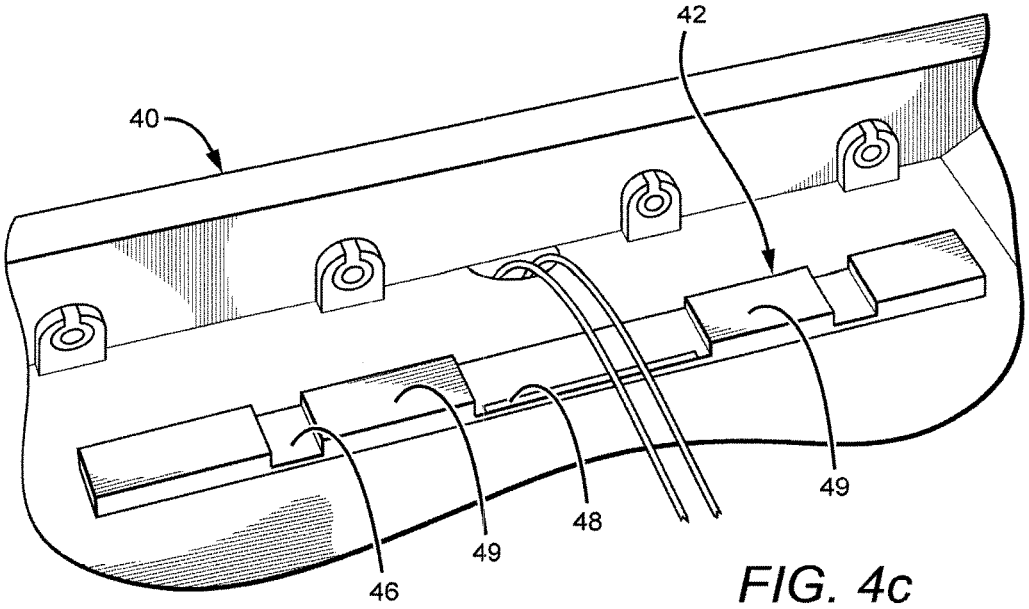
FIG. 4c

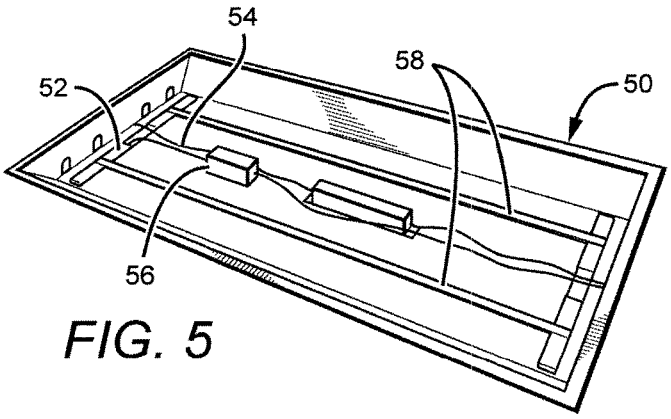
FIG. 5
FIG. 6
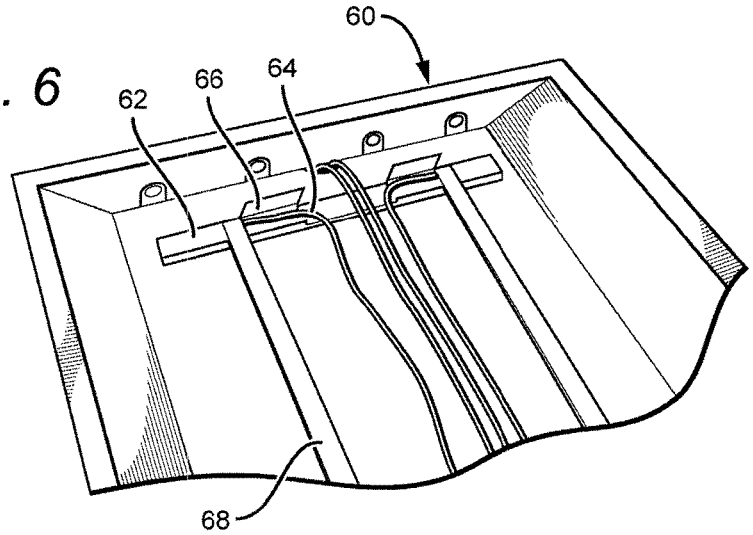
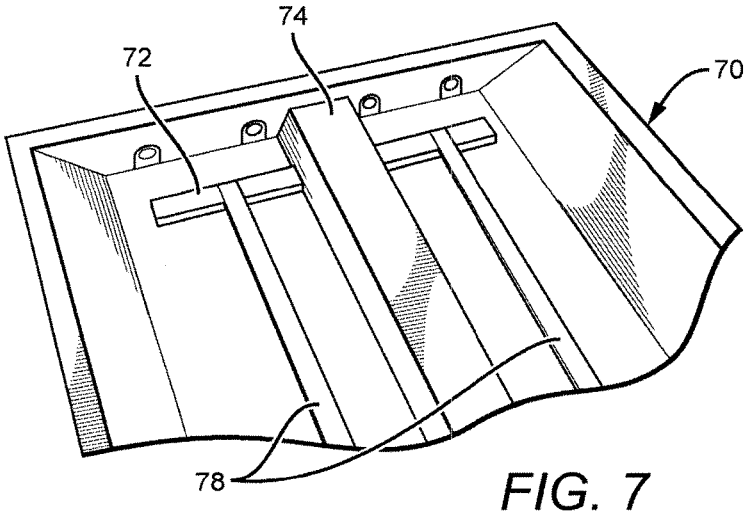
FIG. 7

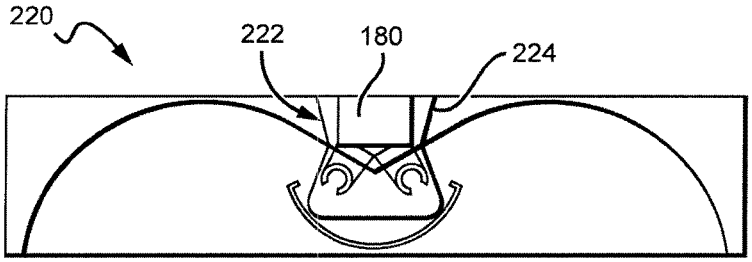
FIG. 19
FIG. 20
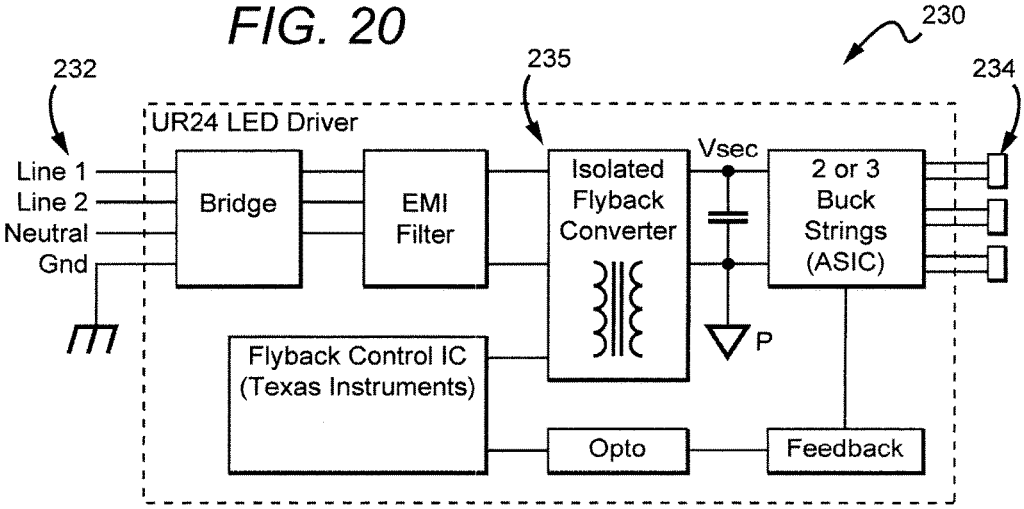
FIG. 21
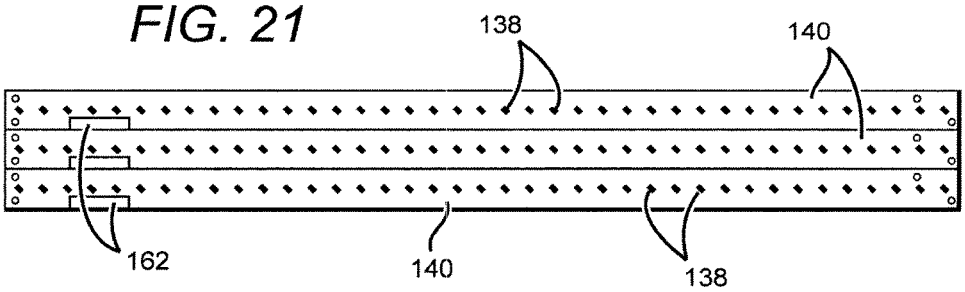

LIGHT FIXTURE RETROFIT KIT WITH INTEGRATED LIGHT BAR

The present application is continuation-in-part of, and claims the benefit of, U.S. patent application Ser. No. 13/672,592, entitled "Recessed Light Fixture Retrofit Kit, and filed on Nov. 8, 2012

BACKGROUND OF THE INVENTION

Field of the Invention

The invention relates to retrofit systems and methods for lighting installations, and in particular, to retrofit systems and methods used to retrofit troffer-style lighting installations with LED light sources.

Description of the Related Art

Troffer-style fixtures are ubiquitous in commercial office and industrial spaces throughout the world. In many instances these troffers house elongated tubular fluorescent lamps or light bulbs that span the length of the troffer. Troffers may be mounted to or suspended from ceilings, such as being suspended by a "T-grid". Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, these troffers have been used with LEDs as their light source. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. Current fluorescent lamp technology can exhibit low efficacy, short lifetime, and can use hazardous materials such as mercury which makes the lamps hard to dispose. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs are attractive to many lighting suppliers and have resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

There has been recent interest in upgrading existing troffer style lighting systems with LED sources (or engines) to capitalize on the above advantages. Current options for upgrading include complete fixture replacement such as by the commercially available CR Series Architectural LED Troffer, provided by Cree, Inc. Some features of these troffers are described in U.S. patent application Ser. No. 12/873,303, titled "Troffer-style Fixture", and assigned to Cree, Inc. Performing complete fixture replacement can require penetrating the ceiling plenum by a skilled technician. This can be time consuming and expensive, and in many locations, building codes can require that a licensed electrician perform any work in the plenum space above a ceiling.

SUMMARY OF THE INVENTION

Some embodiments of the present invention comprise a mechanical mounting system for installing an LED light engine, light source or light bar within an existing lighting system housing or pan, such as a troffer pan, without penetrating the ceiling plenum. Other embodiments of the present invention comprise light bars that are arranged for some of the features to be self-mounting. That is, they have features that allow for mounting to one another without the need for mounting mechanisms such as screws, rivets or brackets, or materials such as adhesives. Other embodiments provide mechanisms for allowing the light bars to be movably mounted in a light fixture housing. The light bars can then be moved on the housing to obtain the desired emission before permanently affixing the light bars in place.

One embodiment of a system for mounting a light source in a fixture comprises a solid state light source bar and mounting clips slidably mounted to said light source bar. The light source bar is arranged so that it can be movably mounted to a light fixture housing. A power supply is included for providing a drive signal compatible with solid state light sources.

One embodiment of a light bar according to the present invention comprises an elongated base and an elongated solid state light source on the elongated base. An elongated lens is included with the base and the lens comprising features to allow for self-mounting of the lens to the base. The elongated light source can be held in place by the lens and base.

One embodiment of a system for mounting an LED light source in a light fixture comprises a power supply capable of receiving a line voltage and generating a signal to drive LEDs. A LED light bar is included having a plurality of LEDs to accept an electrical signal from said power supply to illuminate the LEDs, wherein the light bar has a magnet for non-permanent and movable mounting of said light bar to a light fixture housing.

These and other further features and advantages of the invention would be apparent to those skilled in the art from the following detailed description, taken together with the accompanying drawings, in which:

BRIEF DESCRIPTION OF THE DRAWINGS

FIG. 1 is a perspective view of an exemplary lighting fixture to be retrofitted according to the present disclosure;

FIG. 2 is a perspective view of a lighting fixture with the raceway cover removed according to the present disclosure;

FIG. 3 is a top view of one embodiment of retrofit components according to the present disclosure;

FIG. 4*a* is a perspective view of the fixture of FIG. 2 with one embodiment of mounting brackets in place according to the present disclosure;

FIG. 4*b* is a closer view of a portion of FIG. 4*a* with the one embodiment of power supplies removed for ease of viewability according to the present disclosure;

FIG. 4*c* is a closer view of a portion of FIG. 4*a* according to the present disclosure;

FIG. 5 is a perspective view of a light fixture during the retrofit process with one embodiment light source bars engaged according to the present disclosure;

FIG. 6 is a closer view of a portion of FIG. 5 according to one embodiment of the present disclosure;

FIG. 7 is a perspective partial view of a retrofitted fixture after the raceway cover has been replaced in one embodiment according to the present disclosure;

FIG. 19 is a section view of still another troffer light fixture with one embodiment of a power supply according to the present invention;

FIG. 20 is a schematic of one embodiment of a power supply driver board according to the present invention;

FIG. 21 is top view of one embodiment of light sources according to the present invention;

DETAILED DESCRIPTION OF THE INVENTION

Figure 8:
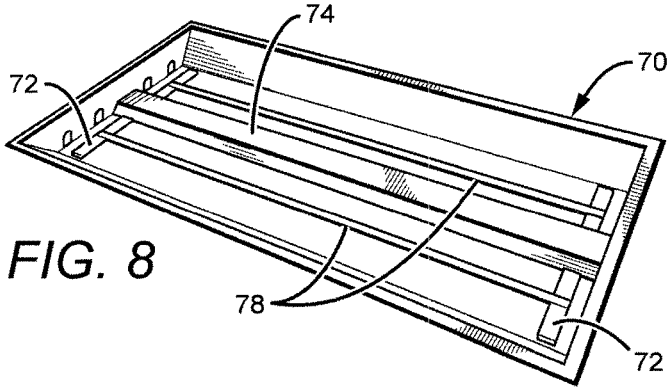
FIG. 8 is a perspective full view of the fixture of FIG. 7 according to the present disclosure.

Embodiments of the present invention provide retrofit systems that can be used with different light fixtures, but that are particularly adapted for use with troffer-style fixtures. These retrofit systems can provide the same amount of light as traditional light fixtures, for example 1600-4000 lumens and above. The retrofit systems can be also used with many different light sources but are particularly well-suited for use with solid state light sources or light engines, such as those utilizing LEDs. The LED light engines can have an elongated form, similar to fluorescent light sources, and can comprise a generally linear array of LEDs. These LED light engines can be referred to herein as a "light source bar" or "light bar". Some embodiments of the present invention comprise a mechanical mounting system for installing an LED light engine within an existing lighting system housing or pan, such as a troffer pan, without penetrating the ceiling plenum.

By leaving the existing troffer pan in place, embodiments of the present invention can rely on the troffer pan to act as a barrier against the spread of fire and smoke. In many areas, local codes may not allow for the use of plastic components inside the plenum space above the ceiling. This is due to concerns that if a fire occurred in one room, toxic smoke from burning plastics could be carried to other locations which share the air plenum. Maintaining the host fixture's troffer pan as a barrier to this spread of toxic smoke can allow for the use of lower cost plastic parts above the ceiling line in the troffer pan. Without the troffer pan barrier, these plastic parts might otherwise not be allowed in the plenum space.

During the upgrade process, contamination may also be a concern, particularly in a hospital or clean room environment. In upgrade processes where the entire fixture is replaced, the sheet metal pan or housing of an existing troffer lighting system is removed. Removing the "host fixture" pan can generate dust which must be contained, and the surrounding area must be cleaned prior to resuming normal operations within the environment. Preventing dust is of particular concern in the case of dust containing dangerous materials such as asbestos. In certain environments, construction permits may be required for an upgrade process that requires removal of the troffer pan, which can add additional complications and costs.

Another alternative upgrade option is by a fixture retrofit where a new LED based light engine or light source bar can be installed into the sheet metal pan of an existing troffer lighting system. This can provide the advantage of using light bars with design features such as reflectors, lenses, and power supplies which have been optimized for an LED-based system. It also allows light bars which are approved for use in other applications to be used in a retrofit application. Some retrofits can provide the advantage of not removing the existing troffer pan, with the pan acting as a barrier to the above-ceiling plenum space. Leaving the pan intact during the retrofit process does not disturb wiring connections, insulation, etc., found in the plenum space. Leaving the pan in place may also allow for work to be performed by non-licensed personal, which can result in a significant cost savings over work performed by licensed electricians.

Many upgrades involve replacing the fluorescent light bulbs/tubes with replacement tubes having LEDs along their length. This upgrade can fit existing fluorescent lamp fixtures and can rely on the fixture's electrical ballast and wiring. However, compared to light engines designed to capitalize on the characteristics of LEDs, these replacement lamps may utilize much more energy for a given light output (lower efficacy), and can provide little or no cost benefit. Furthermore, these upgrades require costly interface connectors to connect to the existing tombstone connections, and older fixtures may have significantly weakened tombstones. In addition, the retrofitter can be forced to rely upon the mechanical and electrical reliability of the original manufacturer and fixture.

The present invention is described herein with reference to certain embodiments, but it is understood that the invention can be embodied in many different forms and should not be construed as limited to the embodiments set forth herein. In particular, the present invention is described below in regards to certain retrofit systems that can be used to retrofit and/or upgrade troffer-style fixtures or lighting systems, but it is understood that the system can be used to retrofit and/or upgrade different types of lighting systems. The retrofit systems can also be used with many different light systems, sources and engines beyond those described herein, with many being LED based.

It is understood that when an element can be referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal, terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "light source", "LED" and "LED component" can be used to indicate a single light emitter or more than one light emitter functioning as a single source. For example, the term may be used to describe a single blue LED, or it may be used to describe a red LED and a green LED in proximity emitting as a single source. Thus, these terms should not be construed as a limitation indicating either a single-element or a multi-element configuration unless clearly stated otherwise.

Embodiments of the invention are described herein with reference to cross-sectional view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

As mentioned above, embodiments of the present invention can comprise a mechanical mounting system for installing an LED light engine or light bar within an existing lighting system pan, such as the opening of a troffer pan, without penetrating the ceiling plenum. The light bar can be provided with mounting features that quickly and easily engages the troffer pan. In some embodiments, these mounting features can comprise a mount bracket or mounting clips and different mount features can be arranged in different ways. Some can be provided as a single piece adaptor, and others being provided as a multiple piece adaptor. Additionally, mounting brackets may be provided with guides or other devices that allow for consistent and error free placement of the mounting bracket during the retrofit process.

In some configurations, the mount bracket may be a multi-function piece of equipment, which serves to correctly orient and space the light bars, hold the light bars in place, and provide a wiring path from the light bars to the power supply, both hiding the wiring and providing desired spacing or enclosures for electrical ratings, such as high voltage regulatory requirements. Initial installation of the mounting bracket may incorporate the use of a temporary holding mechanism to hold the bracket in place until further along in the process when the mounting bracket is secured in place.

In one exemplary retrofit system, the ballast or raceway cover of the original system is temporarily removed to begin the retrofit. Once the raceway or ballast cover is removed, mounting brackets may be placed within the troffer pan. The brackets may be shaped or sized to only fit in the proper installation location, or other types of markers or guides can be used to insure that the brackets are always consistently and correctly placed. Once the mounting bracket is placed in the correct location, and possibly temporarily fastened in place, light bars and wiring can be manipulated in place on the bracket.

If required, a new power supply may be placed in place of or adjacent to the existing power supply, under the raceway or ballast area, under its cover. In some configurations, the power supply may be designed to interface with existing fixture fastening features for ease of installation, such as holes, flanges, and cutouts. The power supply is responsible for delivering the electrical voltage and current to the light source bars. The power supply can receive line voltage from the fixture input (bypassing the existing ballast), for example 120 VAC. Wiring for this power supply may then be passed through a wire routing path in the mounting bracket between the light source and the power supply. This wire routing path may include a separate cover which can be put in place over the wires or a portion of the bracket itself may be used to cover the path, such as a living hinge cover of the wire path.

The mounting bracket may include features to receive and fasten light source bars. Light source bars may be fastened into place on the bracket using a variety of suitable methods, such as but not limited to snap fit, screws, adhesive, twist, interference fit, or press fit. Mounting brackets may be placed at each end of the troffer pan, additional mounting brackets may be included, or any other configuration of mounting brackets may be used.

The light source bars may be any appropriate light source which can be retrofitted in place of a fluorescent light bar. The light source in some configurations may be a plurality of LEDs or other solid state light chips spaced across a circuit board, such as a PCB which may be rigid or flexible. This circuit board with LEDs may be placed within a cover or other holding device. The LEDs may be in series or parallel or a combination of both. Also, the light source may include power supply components or circuitry, or this circuitry may be located separate from the light sources. The light sources may also include a heat sink; however, in configurations where high efficiency LEDs are used a heat sink may not be necessary as the traces on the PCB may be enough to dissipate heat. Previously, light source bars did not use heat sinks which resulted in light source failure. As heat sink and light source technology has matured, heat sinks now are used and required in all applications. Though, traditionally, heat sinks are required for adequate heat dissipation, it is possible in configurations of the light bars to exclude a heat sink and provide sufficient heat dissipation by only using the traces on the circuit board. Inclusion of a heat sink involves the added cost and manufacturing allowances for a heat sink. The light bars of the current disclosure, which do not require a heat sink, allow the light bars to be more efficient in terms of cost and manufacturing.

In some configurations, the light source bars includes a housing. This housing may include a cover over the LEDs. This cover may be translucent and in some configurations include a diffuser to provide a more uniform appearance of the light source. The housing includes a mechanism to hold the PCB in place, such as a snap fit, adhesive, a slide in channel, heat stake, vibration weld, sonic weld, or any other suitable mechanism. The housing may also include features to secure the light source bar to the mounting bracket. The housing provides a rigid form for the light source. Each light source bar may be one rigid piece or multiple rigid sections. Additionally, one light source bar may span an entire troffer pan or multiple portions may be strung together. The housing portion may include optional end caps for closing off or sealing each light source.

Each light source bar is connected to a power supply, directly or via another light source bar. This power supply is responsible for delivering electrical voltage and current to the light source and receives line voltage from the light fixture input. Though each light source may include power supply components, in some configurations, the power supply is separate from the light sources and fits inside the existing fixtures ballast or raceway cover. In some embodiments, the power supply may be designed to interface with the existing fixture fastening features for power supplies, such as holes, flanges and cutouts. In other configurations, the power supply can be fastened with other attachment methods. This power supply may replace the original power supply or simply be installed adjacent to it.

The retrofit systems according to the present invention can convert existing fluorescent fixtures, such as troffer fixtures, into long lasting LED luminaries. By using LED based light sources the cost of the retrofit can be paid back by cost saving from operating efficiency in a relatively short amount of time. The systems can use LED based light sources that offer high efficacy light with excellent color, long lifetime and improved performance. This systems can fit into common lensed and parabolic troffers, wraps, linears and other fixtures where linear fluorescent lamps are currently used. The systems are easy to install with little or no modification to the existing fixture. The upgrade systems can be very easy to install and do not rely on the lamp holders for installation.

In some embodiments the retrofit systems can comprise light bars having a metal/plastic base that can provide rigidity and is arranged to anchor the LED based light source between a lens and the base without the need for permanent mounting elements or materials such as screws, rivets, brackets or adhesives. The base can comprise a channel or opening along its length to provide space for the connectors behind the LED light source and for wires to pass. In some embodiments, the connectors are placed behind the LED board so that they do not cast shadows in the light path. This helps the light bar to provide uniform light emission along its length.

In some embodiment, the lens can clip onto the base and sandwich the LED light source between the two. End caps can be included on the light bars that allow for the connectors to be accessible to the installer and easily connect to the power supply. Mounting clips can be included on the base that allow for temporary placement and alignment of the light bars within the troffer. The light bars can then be permanently mounted to the troffer, such as by metal screws. The mounting clips can be arranged to slide along the metal extrusion and can be moved to desired location. This can allow for the metal clips to avoid any obstructing features within the troffer and can allow for the light bars to be compatible with a wide variety of fixtures. The systems according to the present invention can comprise a power supply that is designed to fit into the existing enclosures in troffers, with output connectors that can be easily plugged into the light bars. The upgrade/retrofit systems according to the present invention can be used in a wide variety of applications where current fluorescent lamps such as convention T8 or T12 lamps are used, and the systems can be used to retrofit different sizes of fixtures such as 2 feet and 4 feet fixtures.

FIGS. 1 and 2 show an existing light fixture with the legacy light engine removed, for example fluorescent light bulbs. The existing light fixture includes a troffer pan 10 and a ballast or raceway cover 12. The legacy tombstone connections 14 can be seen at the top and bottom of the troffer pan 10. The first step in retrofitting the troffer pan 10 with the new light engine or light bar begins with removing the raceway cover 12, as shown in FIG. 2. The legacy power supply components 16 and associated wiring can be found under the raceway cover 12. Following this step, the components of the retrofit light engine can be installed.

FIG. 3 shows exemplary components of a retrofit light engine of one configuration, such as light source bars 32, mounting brackets 34, and a power supply 36. A new power supply 36, which is more suitable for the retrofit system may be installed in place or in addition to the existing power supply 16, shown in FIG. 1. In other configurations, the existing power supply 16 may be used for the retrofit system as well. In yet other configurations, the power supply components may be placed in the light source bars themselves. In another configuration, additional power supplies may be used for 2 or more light bars.

FIGS. 4*a*-4*c* show the next step of the retrofit process which entails the installation of the mounting brackets 42 in the troffer pan 40. This configuration shows both the new power supply 44 and legacy power supply 46 in place within the troffer pan 40. The mounting brackets 42 may be made of any suitable material including plastics or metals. These may be manufactured using an extrusion and post processing method or any other suitable method (injection molding). Although only two mounting brackets 42 are shown in the figures, any number of them may be used in any location. Generally, at least two mounting brackets 42 will be used, with the first two being located proximate to the edges or ends of the troffer pan 40. The mounting brackets 42 are multi-functional brackets as they serve to fix the light source bars in place, insure that the light source bars are oriented correctly, and also provide a wiring path for connecting the light source bars to power.

Considering that most retrofittings would occur while a light fixture is already installed in a ceiling, it is beneficial to provide features which make the retrofit process easier and as close to error free as possible, while working with a fixture that is overhead and cannot be manipulated. Therefore, in some configurations, the mounting brackets 42 will include guides or guiding features (not shown) to allow for consistent and error free mounting within the troffer pan 40. Such guides or guide features may include shaping which prevents the mounting brackets from being mounted in a location other than the correct location. In another embodiment, the guide features may include extensions such as markers which can come in contact with the edges of the troffer pan and provide accurate orientation of the mounting brackets in relation to the troffer pan. In yet another embodiment, an installer may use marks or features of the troffer pan itself (or mounting brackets) to correctly orient and mount the mounting brackets.

Some configurations may include a temporary fastener to the troffer pan 40 to facilitate installation of the mounting brackets 42. A temporary fastener may be a pressure sensitive fastener, such as an adhesive, or any other suitable temporary fastening mechanism such as screws, press fit, snap fit, twist, or interference fit. This would allow the installer to place the mounting bracket in the correct location and continue with the retrofit process without having to hold the mounting bracket in place until the mounting bracket can be fully secured.

FIGS. 4*b* and 4*c* show closer images of the mounting bracket 42 in place but not finally secured. As shown, the mounting bracket 42 extends across the troffer pan 40, such that a portion of the mounting bracket 42 would be under the raceway cover when the raceway cover is reinstalled. In this configuration, the raceway cover would hold and secure the mounting bracket 42 in place (and relieve the temporary fastening mechanism of reliable mounting). The mounting bracket includes a ballast or raceway cover stand-off portion 48, to space the raceway cover from the mounting bracket slightly, allowing wires to pass under the raceway cover to the wire path 49 without being pinched or chaffed. In other configurations other suitable methods may be used to prevent pinching of the wires, such as indentations in the mounting bracket.

Moving outward from the center of the mounting bracket 42, past the wire path 49 is the light source bar mounting or engaging portion 46. This area 46 is where light source bars engage or mount to the mounting bracket 42. The mounting bracket 42 includes features to interface with the light source bar. In some configurations, the light source bars snap into place in the engaging portion 46. However, in other configurations, the light source bar may be fastened using other mechanisms, such as press fit, screws, twist fit, adhesives, interference fit, or any other suitable fastening mechanism. In retrofits which have multiple light source bars, the mounting bracket may have predefined interface locations so the installer can position them correctly.

As can be seen in the troffer pans 50, 60 shown in FIGS. 5 and 6, the wires 54, 64 from a power supply 56 are passed through a wire path 66 of mounting brackets 52, 62 to light source bars 58, 68. The wire path 66 provides an enclosure to both protect and hide the wiring, although neither may be necessary. Wire protection may prevent the wires from being cut, damaged, or otherwise harmed, as they may be when exposed. The wire path includes a way to provide access to pass the wires. Access to the wire path 66 may be provided by a hinged or removable portion. In FIG. 4*c* the wire path is shown with the hinged or removable portion in place and therefore the wire path 49 is enclosed. In FIG. 6 the wire path 66 is shown open with a hinged portion. This hinged portion may be constructed using a living hinge. A living hinge is preferable as it mitigates the need for a separate cover. (other hinges can also be used) Other embodiments may use a removable portion which could be a secondary snap cover or a cam in place cover.

Next, referring to FIGS. 7 and 8, after the mounting brackets 72, optional power supply, light source bars 78 and wiring are in place, the ballast or raceway cover 74 may be reinstalled in its original position in the troffer pan 70, now over and securing the mounting brackets 72. The retrofit is complete at this stage.

Figure 9:
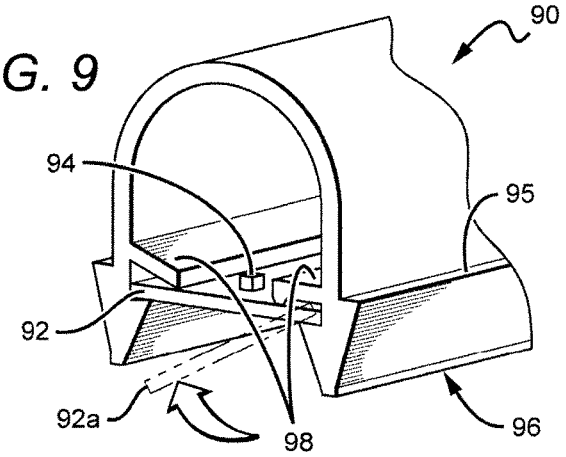
FIG. 9 is a side cross section perspective view of one embodiment of a light source bar according to the present disclosure.
Figure 10A:
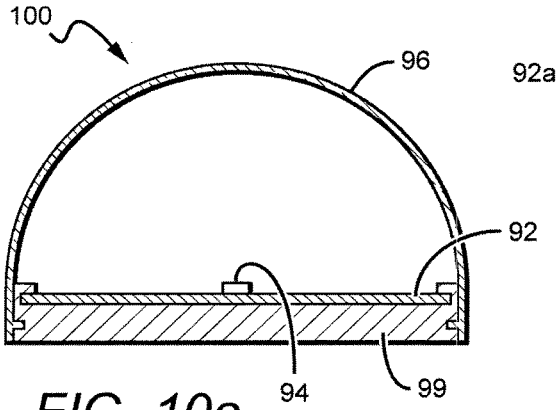
FIG. 10*a* is a side cross section view of another embodiment of a light source bar according to the present disclosure.
Figure 10B:
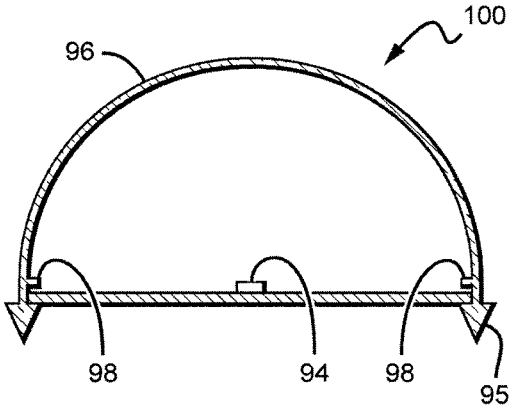
FIG. 10*b* is a side cross section view of another embodiment of a light source bar according to the present disclosure.

The light source bars may be configured and constructed in a variety of manners. FIGS. 9-10*b* show some configurations of light source bars and light source bar housings. Light source bar 90, 100 may include several components such as a housing 96, circuit board 92, and light source chips or LEDs 94. Generally, the LEDs are spaced uniformly across the circuit board to provide uniform lighting; however, they may be placed or spaced in any way preferred for a particular lighting application. The housing 96 may include several portions as well, such as a translucent or diffuse top portion, which functions to both protect the LEDs and as a lens. A lens is not required and can be omitted in some configurations. The housing can be a single extrusion or can include multiple portions. It is only required that the areas through which light will be omitted be clear or diffuse; however, to simplify manufacturing the entire housing may be clear or diffuse.

The housing may also include holding features 98 to keep the circuit board 92 in place. The holding feature 98 may be advantageous in some configurations because it can also function to hold in place reflective layers or coatings on the circuit board which may come loose when the adhesive used to apply the layer fails. Holding features 98 may also be coextruded in a reflective white material to replace an often used reflective film. Some light source bars, such as the one shown in FIG. 10*a*, may also include a heat sink 99. However, as discussed previously it is possible, and may be advantageous, to omit the heat sink 99 in some configurations, using alternate methods to dissipate heat, such as the traces on the circuit board.

The circuit board 92 may be any suitable circuit board including those that are rigid or flexible. In the configuration shown in FIGS. 9 and 10*b*, the circuit board 92 is pivoted into place, or one may cam in the circuit board 92*a* and then snap it in place. The housing 96 should be at least in part rigid to support the circuit board and to aid in mounting and holding in place the light source bar 90. The entire light source bar 90 may be a single rigid portion, or it may comprise of multiple rigid portions.

The light source bar 90, 100, or housing portion of the light source bar 90, includes features to engage it with the mounting bracket. These features may include screws, adhesives, twist fit, press fit, interference fit or snap fit features. In the configuration shown in FIGS. 9 and 10*b*, features to provide a snap fit 95 are shown. However, it will be understood that any appropriate engaging feature may be used. These engagement features may run across the entire length of the light source bar 90 or may only exist in designated portions which are known to possibly engage with a mounting bracket, such as the ends and in some cases intervening sections. Though not shown, the light source bar 90 may also include an end cap which includes features 95 to engage the light source bar. In some cases, multiple light source bars may be strung together across one troffer pan.

Figure 11:
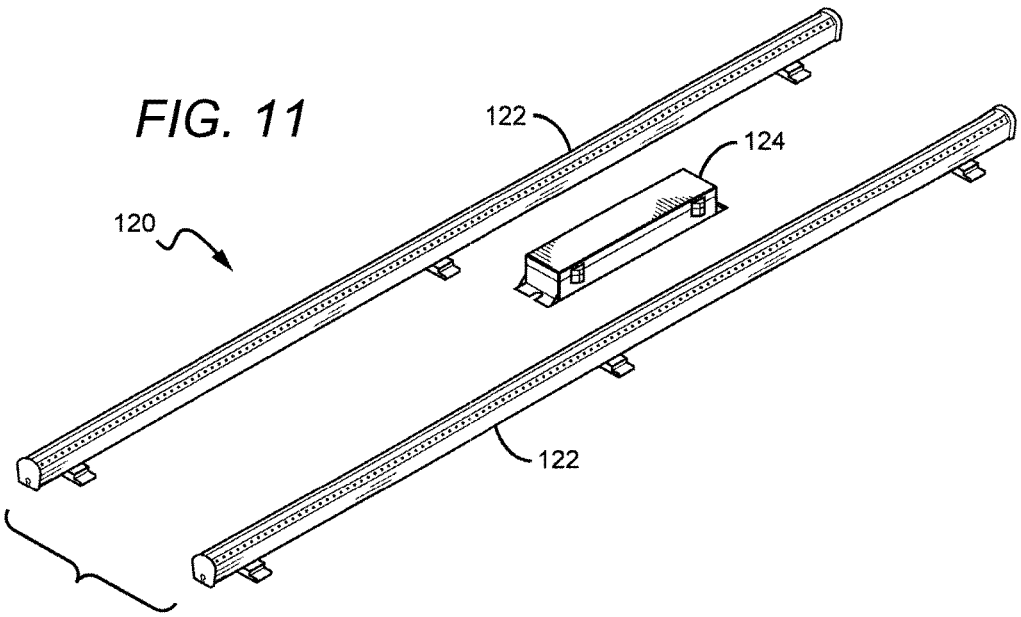
FIG. 11 is a perspective view of one embodiment of lighting retrofit system according to the present invention.
Figure 12:
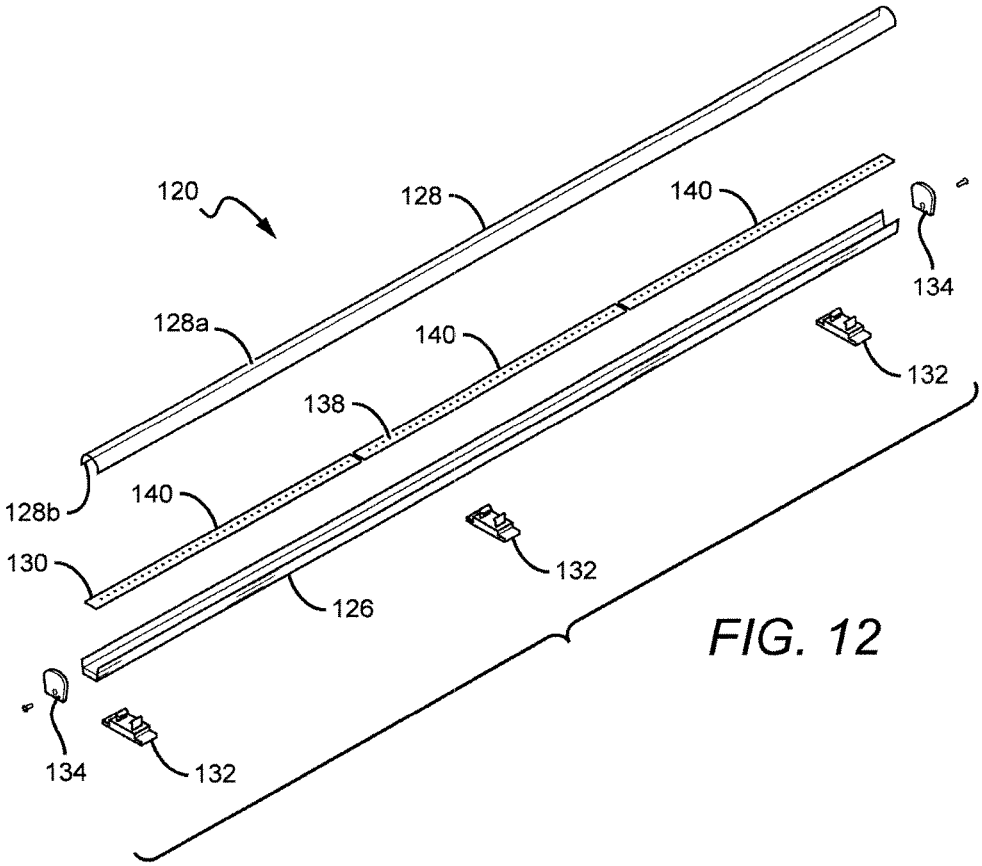
FIG. 12 is a perspective exploded view of one embodiment of a light source bar according to the present invention.
Figure 13:
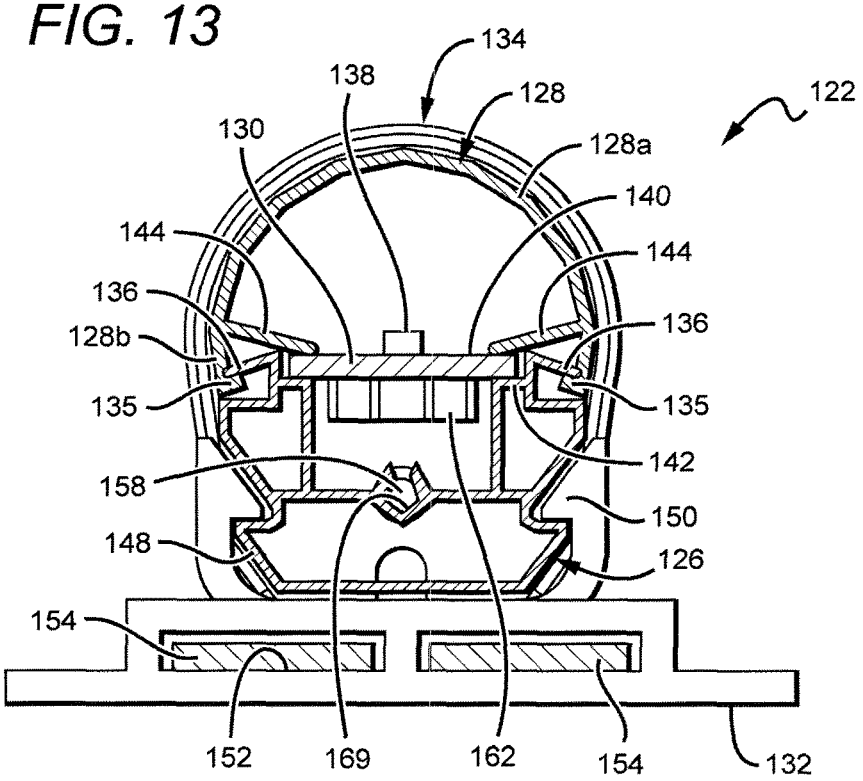
FIG. 13 is a sectional view of one embodiment of a light source bar according to the present invention.
Figure 14:
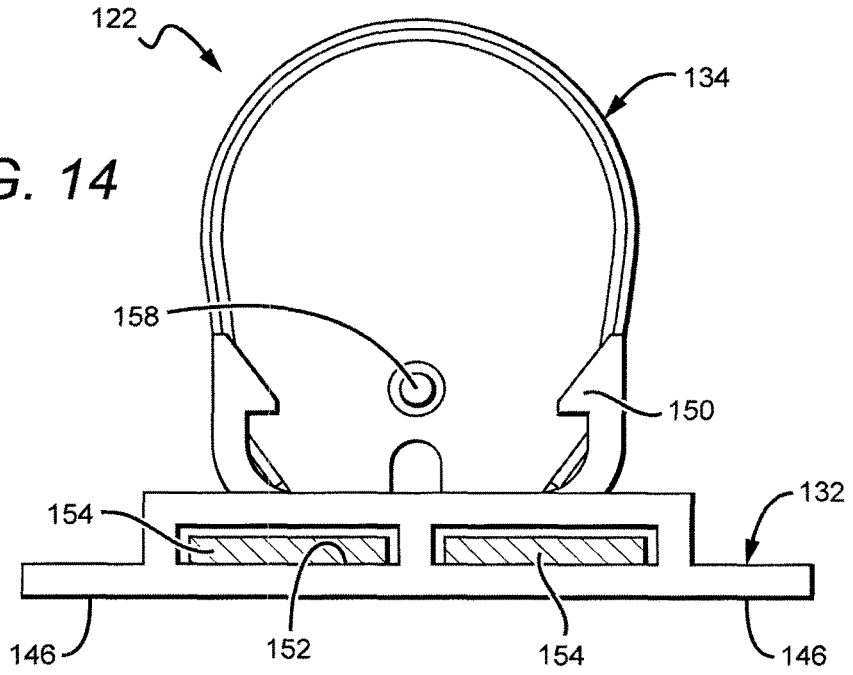
FIG. 14 is an end view the light source bar shown in FIG. 13.

Different embodiments of the present invention can be arranged in many different ways and with many different features, and can be utilized in many different light fixtures. The light engines or light bars can utilize many different mounting mechanisms beyond those described above, and can comprise power supplies arranged in different ways. FIG. 11 shows another embodiment of a system 120 for mounting LED based light engines or light bars in a light fixture such as a troffer pan, and FIGS. 12-14 show one embodiment of a light bar 122 that can be used in the systems according to the present invention. The system 120 can be used when retrofitting an existing troffer-type luminaire or when installing new troffer-type luminairs. The system 120 comprises one or more light bars 122 and a power supply 124, with the power supply 124 arranged to provide an electrical signal to the light bars 122 causing them to emit light. It is understood that other systems according to the present invention can have more or fewer than two light bars, and can comprise more than one power supply.

Referring now to FIG. 11 in conjunction with FIG. 12-14, each light bar 122 can be arranged to allow for convenient placement and mounting in light fixture (i.e. troffer pan), with some embodiments not utilizing mounting brackets as described above and shown in FIGS. 3 and 4*a*-4*c*. It is understood, however, that some embodiments can be used in combination with the mounting brackets described above. In the embodiment shown, each light bar 122 can comprise an elongated base 126, an elongated lens 128, and elongated light source 130, and mounting clips 132, all described in more detail below. End caps 134 can also be mounted at each end of the light bar 122 to protect its internal components.

The base 126 can be made of many different rigid materials, such as metal or plastic, and can be fabricated in many different ways. In some embodiments, the base 126 can comprise aluminum and can be fabricated using known extrusion methods. The base 126 can serve as the central mechanical mount or feature of the light bar, and in the embodiment shown, most of the remaining light bar elements can be mounted to the base 126 without mounting elements such as screws, rivets, brackets or adhesives as further described below. It is understood, however, that in other embodiments these mounting mechanisms can be used. The base can have openings or channels that reduce the amount of material necessary to form the base and also allow for formation of certain mounting features as described below, as well as passageways for the light source connector and connection wires.

The lens 128 can be made of many different materials and can be fabricated in many different ways. In some embodiments, the lens 128 can be made of a material that transmits the light from the light source 130, while at the same time being UV stable to avoid yellowing over time. The lens 128 can comprise many different commercially available materials, such as commercially available plastics, and can be formed using known extrusion processes. The lens 128 can also comprise dispersing materials or other features to help mix light from the light source 130. In the embodiment shown, the lens 128 has a top portion 128*a* with a substantially hemispheric cross-section, and a bottom portion 128*b* with features that allow for the lens 128 to cooperate with the base 126 so that it can be mounted to the base 126 without the use of mounting mechanisms or materials. The bottom portion of the lens 128 has two inward and opposing lens flanges 135, and base 126 has two outward facing base flanges 136. The lens 128 can be held in place to the base 126 by the overlapping of the lens and base flanges 135, 136.

The light source 130 can be arranged in many different ways and can comprise many different light sources. In the embodiment shown, the light source 130 comprises LEDs 138 mounted on a PCB/submount 140 having conductive traces or wire bonds to interconnect the LEDs 138. In submount embodiments, the submount can comprise sapphire, ceramic or silicon or any other suitable material, such as T-Clad thermal clad insulated substrate material, available from The Bergquist Company of Chanhassen, Minn. For PCB embodiments different PCB types can be used such as standard FR-4 PCB, metal core PCB, or any other type of printed circuit board. It is further understood that the PCB/submount can comprise many other elements made of different materials. In some embodiments it can comprise a reflective element made of a material that reflects or disperses light from the LEDs. In some embodiments this reflective element can be made of different material including plastics, various polymers, polycarbonates or combinations thereof. In some embodiments it can be reflective white material. In still other embodiments it can comprise a material with a layer of white or specular reflecting materials. Is these different reflective element embodiments, the LEDs can be interconnected in different ways such as by Copper Wire/Rails, magnet wire (e.g. copper wire coated with an insulator such as enamel), flex circuit, flattened braided wire, conductive foil, or a plastic or other non-conductive material selectively coated with a conductive material. The LEDs can be mounted to these different interconnections using different materials such as conductive Adhesives, low temperature solder, sonic/vibration welding, or conventional soldering.

The LEDs 138 can comprise many different LEDs, or LED components/packages such as those commercially available from Cree, Inc., including but not limited to the XLampCX, XLampM and XLampX family of LED packages. Embodiments having LEDs can comprise many different LEDs commercially available from Cree Inc., under its DA, EZ, MB, RT, TR, UT and XT families of LED chips. In the embodiment shown, the LEDs can comprise LED components described in U.S. patent application Ser. No. 13/649,052, entitled "LED Package With Encapsulant Having Planar Surfaces," and U.S. patent application Ser. No. 13/649,067, entitled "LED Package With Multiple Element Light Source and Encapsulant Having Planar Surfaces," both of which are assigned to Cree, Inc., and both of which are incorporated herein by reference.

The light source 130 can be mounted within the light bar 122 in many different ways, and in some embodiments can be mounted in place without the use of permanent mechanical mounting devices such as screws and rivet, or without the need for adhesives. In some embodiments, the light source 130 can be held in place by other elements of the light bar. In light bar 122, the base can comprise an inner shelf 142, with the light source 130 positioned on the shelf 142. The lens 128 can comprise inner tabs 144 that extend from the inner surface of the lens 128 toward to light source 130. When the lens 128 is mounted to the base 126, the tabs 144 contact the top surface of the PCB 140 with a downward pressure. This allows for the light source 130 to be held in place between the tabs 144 and the shelf 142. In some embodiment, at the tabs 144 can be made of a light reflective material to reflect light from the LEDs 138 to contribute to the desired emission from the light bar 122.

The mounting clips 132 are also mounted to the base 126 and are arranged such that they can slide along the base 126 to the desired position. The mounting clips 132 have mounting clip extensions 146 that are positioned to contact the inner surface of the light fixture or troffer pan. The base has notches 148 shaped to cooperate with mounting clip tabs 150 to hold the mounting clips 132 on the base 126 while allowing the mounting clips 132 to slide along the base 126. The mounting clips can have many different shapes and sizes and can be made of many different materials. In the embodiment shown, the mounting clips 132 can be made of plastic and can be formed by extrusion or injection molding processes.

The light bars according to the present invention can also comprise mechanisms to hold the light bars to the luminaire housing to allow positions of the light bars prior to permanent mounting. In some embodiments this can comprise materials such as non-permanent adhesives, while in other embodiments the light bars can have one or more magnets positioned to hold the light bar 122 to metallic troffer pans prior to permanently mounting the light bars (such as with screws). In some embodiments, the magnets can be in or one or more of the mounting clips 132. In the embodiment shown, the mounting clips have longitudinal cavities 152 that can house magnets 154 such that the magnetic force from the magnets holds the light clip to the troffer pan. This in turn holds the light bar to the troffer pan. In other embodiments, the magnets can be in other locations, such as on the mounting clip extensions 146 or in/on other portion of the light bar, such as the base 126, light source 130 or lens 128.

The mounting clips can also have features that allow for the permanent mounting of the light bar to a light fixture. In some embodiments, the mounting clip extension can comprise mounting holes sized for a screw to pass and turn into a hole in the troffer pan. It is understood that other mounting mechanisms or permanent adhesives can be used. In different embodiments less than all of the mounting clips can be used for permanent mounting, and some can be used only for temporary mounting for light bar placement. It is also understood that light bars can be included where less than all of the mounting clips have magnets and where mounting clips of different shapes and sizes can be used with one of the mounting clips. In some embodiments the entire mounting clip can be made of a magnetic material, or as in the embodiment shown only a portion of the mounting clip can be magnetic. The magnets can be many different shapes and sizes such as rectangular, circular or triangular, and can have many different numbers, shapes and sizes of magnets.

It still other embodiments, the holding mechanisms or materials can be provided on the light fixture instead of on the light bar or its mounting clips. In these embodiments the temporary adhesive or magnets can be on, for example, the troffer pan and a portion of the light bar can be adhesive or magnet. In the embodiments where magnets are used, portions of the light bar or mounting clips should be made of a metallic material that is held by the magnetic field of the magnets.

The light bars 122 can also comprise end caps 134 that can be cover the ends and protect the components within the light bars 122. The end caps can be made of many different materials, with some embodiments comprising a plastic fabricated by injection molding. The end caps 134 can be mounted to the light bars using mounting mechanisms or adhesives. In the embodiment shown, the end caps 134 are mounted to the base 126 using screws 158, each of which is sized to pass through a hole in the end caps 134 and cooperate with hole 169 in the base. The end caps further comprise a wire hole 160 that allows a connecting wire (not shown) to pass through the end cap 134 for connection to the light source 130. The other end of the connection wire can be coupled to a power supply, so that a drive signal from the power supply can be conducted to the light source 130. The light source 130 can comprise many different mechanisms for connection to the connecting wire, with some embodiments comprising a bottom connector 162 that is arranged at the bottom of the PCB 140 and can be at one of the PCB to allow for easy access for wire connection. By being positioned at the bottom, the bottom connector 162 does not interfere with or block the emission of the LEDs 138.

The components of the light bar 122 as described in the embodiment above allow for convenient and simple assembly and use. The base 126 serves as the central mechanical foundation with the remaining primary components mounted to the base without the need for mechanical mounting elements such as screws, rivets or brackets, or without adhesives. The light source 130 is arranged on the inner shelf 142 and the lens 128 can be slid or snapped in place to base 126. The light source 130 is held in place between the base 126 and the lens 128. Both the lens 128 and the light source can be easily removed by hand, such as by sliding the lens 128 off the base 126. The mounting clips 132 can also be mounted to the base without screws, rivets, brackets or adhesives as described above, and can easily be removed. The end caps 134 are the only primary light bar elements that are mounted in place by a screw as described above. The mounting clips 132 also cooperate with the base so that after mounting of light bar 122 in a light fixture, the base 126 can be removed from the mounted mounting clips and a replacement light bar can be snapped into the mounting clips.

The light bars according to the present invention can have many different shapes and sizes, and in some embodiments the light bar can be in the range of approximately 5 to 200 inches. In some embodiments, the light bars can be approximately 21 inches long or approximately 42 inches long. The lens can have many different widths, such as in the range of 0.5 to 3 inches, with some embodiments having a width of approximately 1.10 inches. Similarly, the light bar can have many different heights, such as in the range of 0.5 to 4 inches, with some embodiments having a height of approximately 1.5 inches. The mounting clips according to the present invention can have many different lengths, such as in the range of 0.5 to 6 inches, with some embodiment having a length of approximately 2.0 inches. It is understood that these are only some examples of the different dimensions, and other embodiments can have that many others dimensions.

Figure 15:
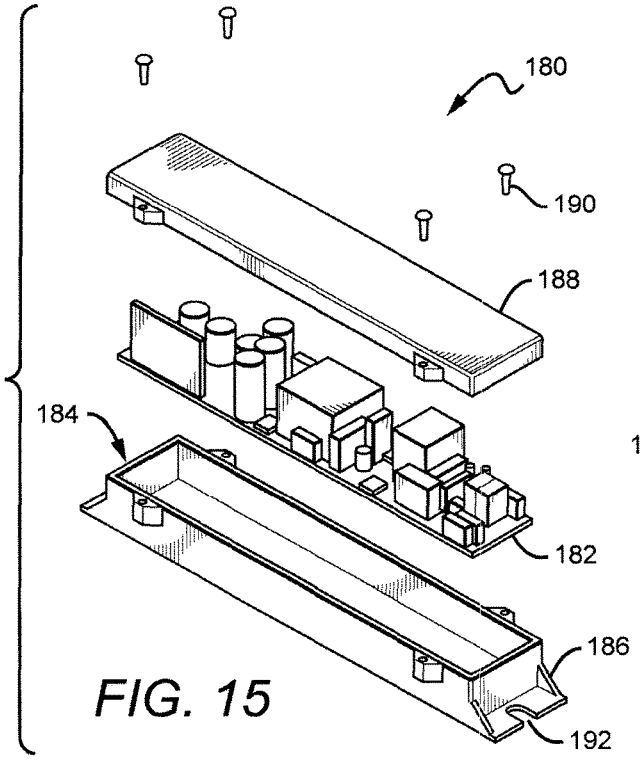
FIG. 15 is a perspective exploded view of one embodiment of a power supply according to the present invention.
Figure 16:
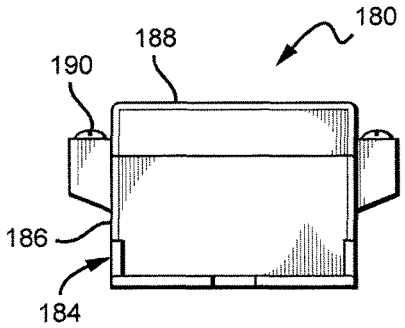
FIG. 16 is an end view of the power supply shown in FIG. 15.

The system 120 can also comprise a power supply 180 with FIGS. 11, 15 and 16 showing one embodiment of a power supply according to the present invention. The power supply 180 can be sized and arranged for mounting in a ballast or raceway of a troffer pan, as described above. The power supply 180 can receive line voltage from the fixture input, for example 120 VAC, and can comprise components that deliver an electrical voltage and current to the light bars 122 appropriate for driving LEDs. In some embodiments the voltage and current can be delivered through the connection wires. The power supply 180 generally comprises a driver board 182 arranged in a housing 184 that comprises a bottom 186 and top 188 held together by screws 190. In other embodiments, the bottom and top 186, 188 can be arranged such that they can snap fit together, while in other embodiments the bottom and top 186, 188 can be glued together. There are only a few of the ways in which the housing 184 can be assembled, and other embodiments can comprise other pieces fitting together in different ways to form the housing 184. The housing can be made of many different materials, such as plastics, metal or combinations thereof.

The driver board can be accessed by removing the screws 190 and removing the top 188 from the bottom 186. The power supply also comprises mounting slots 192 that hold the power supply 180 in place to the troffer pan by screws. In some embodiments, the power supply can also provide dimming feature, while in other embodiments the power supply can provide for low voltage operation of the light bars 122. This can provide the advantage of allowing for connection wiring between the power supply and light bars to pass outside of wire covers. This in turn can allow for less complex and less costly installation.

The power supply can be many different shapes beyond that shown in the FIGS. 15 and 16, and can be many different sizes. In some embodiment, the power supply can be in the range of 2 to 20 inches long, with some embodiments being approximately 9.5 inches long. In some embodiments is can have a width in the range of 0.5 to 6 inches, with some embodiment being approximately 2.3 inches wide. Some embodiments can have a height in the range of 0.5 to 5 inches, with some embodiments being approximately 1.3 inches high.

Figure 17:
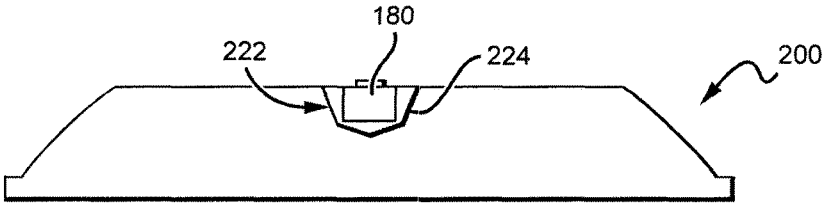
FIG. 17 is a section view of a troffer light fixture with one embodiment of a power supply according to the present invention.
Figure 18:
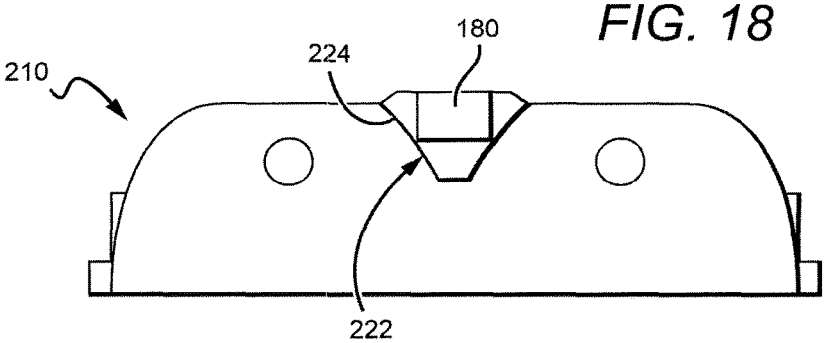
FIG. 18 is a section view of another troffer light fixture with one embodiment of a power supply according to the present invention.

FIGS. 17, 18 and 19 show different types of conventional troffer light fixtures 200, 210 and 220, each of which comprises a raceway 222. The power supply 180 can be sized such that it fits under the raceway cover 224 for each of these different fixtures, making the power supply 180 compatible for retrofitting these fixtures. FIG. 20 is a driver board schematic 230 showing one embodiment of the components that can be found on a driver board and their interconnections. The driver board has inputs 232 that can accept receipt line voltage at lines 1 and 2, internal components 235 to convert the signal, and outputs 234 that can provide two or three drive signals to the light bars.

The system 120 can be arranged with different numbers of light bars 122 that can be arranged with different numbers of LEDs that can also be arranged in different serial/parallel combinations. As best shown in FIG. 12, the light source 130 can comprise different number of PCBs 148 connected in series, with the embodiment shown having three PCBs 140 connected in series. Each of the PCBs can have LEDs interconnected in different series and parallel combination. FIG. 21 shows one embodiment of the PCBs 140 shown side by side for ease of illustration. Each of the PCBs 140 can have different numbers of LEDs 138, and in the embodiment shown each PCB 140 has 39 interconnected LEDs 138. The PCBs 140 can also have other features, such as a connector 162. An electrical signal applied to the connector 162 causes the LEDs on each corresponding light source to emit light, and in some embodiments the PCBs 140 can be interconnected through their connectors 162.

Figure 22:
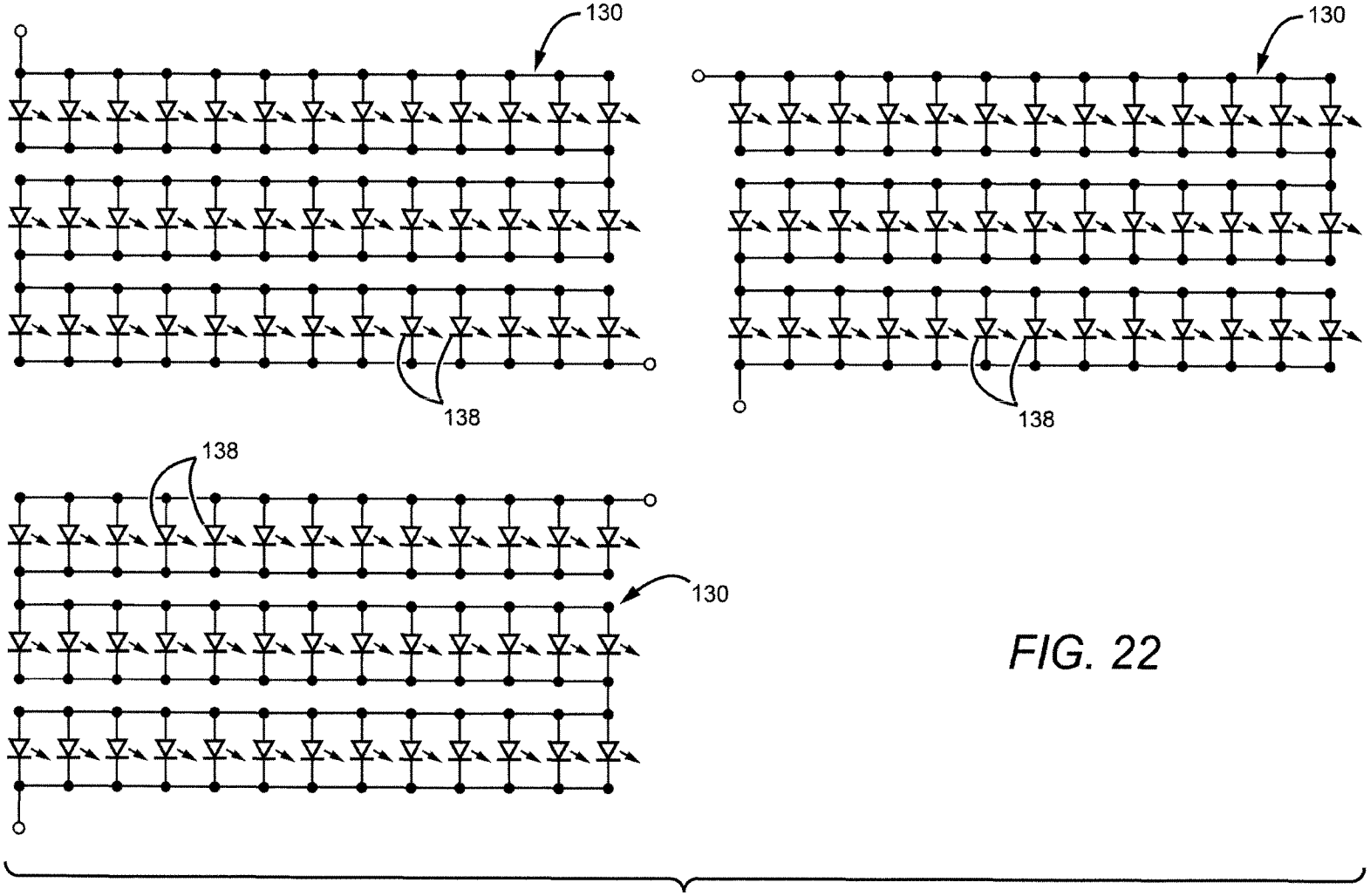
FIG. 22 is a schematic showing one embodiment of the interconnections of the LED is the light sources of FIG. 21.

FIG. 22 is a schematic showing one embodiment of interconnections for the LED 138 on the PCBs 140 shown in FIG. 21. As mentioned above, the LEDs 138 can be interconnected in many different serial and parallel combinations. In the embodiment shown, the LEDs 138 on each PCB can comprise three sets of 13 parallel interconnected LEDs, with the sets interconnected in series. Each of the PCBs 140 can comprise 39 interconnected LEDs 138, with a light bar having three interconnected PCB having 117 interconnected LEDs. It is understood that FIGS. 21 and 22 illustrate only one embodiment, and that different embodiments can have different numbers of LEDs. In some embodiments the PCBs in one light bar can have different numbers of LEDs that can be interconnected in different serial and parallel combinations. It is further understood that in some embodiments, all the LEDs can be similar and emit the same or similar color of light. In other embodiments the LED can comprise different types of LEDs and/or different LED that emit different colors of light.

Different embodiments of the present invention can be used in retrofitting troffer pans and provide for flexibility and convenience in installation. The light bars can be placed in the troffer pan and can be held in place by the mounting clip magnets. The placement of the light bars can be adjusted as desired by simply moving the light bars, with the magnets holding the light bar in the new location. The mounting clips can also be slid up or down the light bars to the desired location. This can allow for aligning the mounting clip holes with existing holes in the troffer pan. The existing holes can be used again by the mounting clips to minimize the creation of new holes in the troffer pan. The power supply can then be mounted in the desired position, such as along the raceway of the troffer pan, and the power supply can be connected to the line supply and to the light bars. The light bars can then be illuminated to determine if they produce the desired troffer emission. The position of the light bars can then be further adjusted to achieve the desired emission. The light bars can then be mounted in place such as by screws passing through the mounting clip holes.

Figure 23:
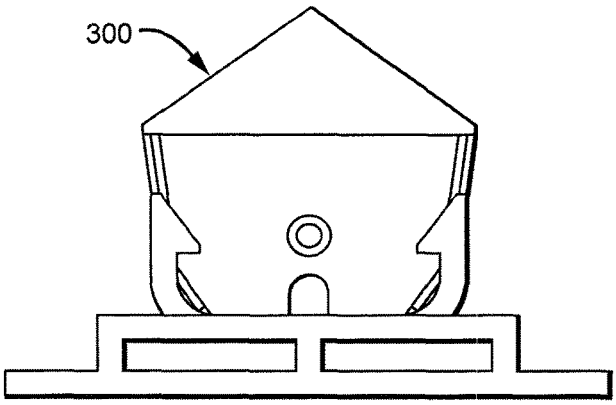
FIG. 23 is a sectional view of another embodiment of a light source bar according to the present invention.
Figure 24:
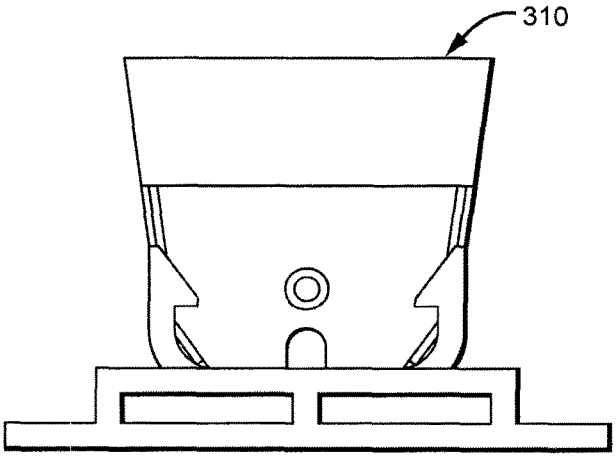
FIG. 24 is a sectional view of another embodiment of a light source bar according to the present invention.
Figure 25:
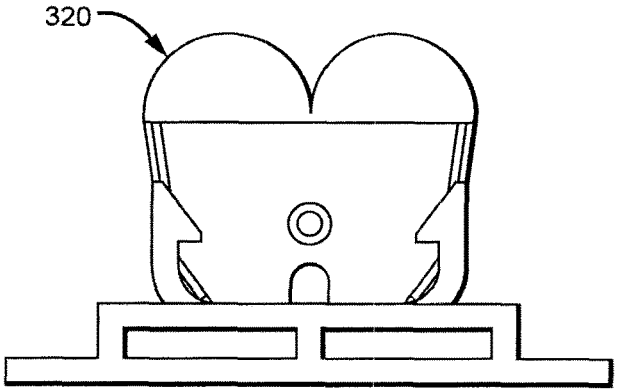
FIG. 25 is a sectional view of still another embodiment of a light source bar according to the present invention.

It is understood that the components of the light bars and power supplies according to the present invention can be arranged in many different ways with many different shapes and sizes. The base 126 can be made of many different materials and can have different numbers of channels or openings with different shapes and sizes. The light sources can similarly be arranged in many different ways with different numbers of LEDs, LED components or LED packages interconnected in different ways. The lens can also have many different shapes and sizes. FIGS. 23, 24 and 25 show examples of different lens shapes 300, 310 and 320 that can be used in different light bars according to the present invention. It is understood that these are only a few of the shapes that can be used.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

We claim:

1. A system for mounting a light source in a fixture, comprising:

at least two solid state light source bars each comprising a base, a lens, and a light source, said light source held in place by a force applied by an inner portion of said lens, said base coupled to said inner portion of said lens;

mounting clips mounted to said at least two solid state light source bars, wherein said at least two solid state light source bars can be movably mounted to a light fixture housing, said mounting clips comprising a magnet, wherein said mounting clips are slidably adjustable along said at least two solid state light source bars; and a power supply for providing a drive signal compatible with solid state light sources, said power supply configured to removably attach to said light fixture housing such that said power supply is between said at least two solid state light source bars.

2. The system of claim 1, wherein said mounting clips provide a non-permanent holding force to moveably hold said at least two solid state light source bars to said fixture housing.

3. The system of claim 1, wherein said mounting clips comprise at least one cavity.

4. The system of claim 3, wherein said at least one cavity is longitudinal.

5. The system of claim 3, wherein said magnet is at least partially within said at least one cavity.

6. The system of claim 2, wherein said non-permanent holding force comprises a non-permanent adhesive.

7. The system of claim 6, wherein said non-permanent adhesive is on at least one of said mounting clips.

8. The system of claim 1, wherein said light fixture housing comprises a troffer pan.

9. The system of claim 1, further comprising mounting brackets.

10. The system of claim 1, wherein said lens and said light source are self-mounted to one another.

11. The system of claim 10, further comprising end caps.

12. The system of claim 1, wherein said at least two solid state light source bars are rigid.

13. The system of claim 1, further comprising a mechanism for permanently mounting said at least two solid state light source bars in place in said light fixture housing.

14. The system of claim 13, wherein said mechanism comprises a permanent adhesive.

15. The system of claim 13, wherein said mechanism comprises screws to pass through screw holes in at least one of said mounting clips to turn into holes in said lighting fixture housing.

16. A system for mounting a light source in a fixture, comprising:

at least two light bars, wherein each of said at least two light bars comprises:

an elongated base;

an elongated solid state light source on said elongated base;

an elongated lens, said elongated base and an inner portion of said elongated lens comprising features to allow for self-mounting of said elongated lens to said elongated base, said elongated solid state light source held in place by a force applied by said inner portion of said elongated lens onto part of said elongated solid state light source; and a power supply configured to removably attach to said fixture such that said power supply is between said at least two light bars.

17. The system of claim 16, further comprising mounting clips.

18. The system of claim 17, wherein said mounting clips are slidably mounted to said elongated base.

19. The system of claim 16, wherein said elongated solid state light sources are held in place between said elongated lenses and said elongated bases.

20. The system of claim 16, further comprising end caps.

21. The system of claim 16, further comprising a means for non-permanent mounting of said light bar to a surface.

22. The system of claim 21, wherein said means comprises a non-permanent adhesive.

23. The system of claim 22, wherein said means comprises a magnet.

24. The system of claim 17, further comprising a magnet mounted to at least one of said mounting clips.

25. A system for mounting an LED light source in a light fixture, comprising:

a power supply capable of receiving a line voltage and generating a signal to drive LEDs; and at least two LED light bars each comprising a plurality of LEDs to accept an electrical signal from said power supply to illuminate said plurality of LEDs, wherein said at least two LED light bars each comprise a magnet at least partially within said at least two LED light bars for non-permanent and movable mounting of said at least two LED light bars to a light fixture housing, wherein said magnets are slidably adjustable along said at least two LED light bars;

wherein said power supply is configured to removably attach to said light fixture housing such that said power supply is between said at least two LED light bars.

26. The system of claim 25, wherein said at least two LED light bars further comprise slidable mounting clips.

27. The system of claim 25, further comprising a mechanism for permanently mounting said at least two LED light bars in place.

28. The system of claim 25, wherein said light fixture comprises a troffer-type light fixture.

29. The system of claim 1, wherein said magnets are at least partially within at least one of said mounting clips.

* * * * *